US012774128B2

(12) United States Patent
Davis

(10) Patent No.: US 12,774,128 B2
(45) Date of Patent: Oct. 27, 2026

(54) CONTAINER

(71) Applicant: Multi Packaging Solutions UK Limited, Nottingham (GB)

(72) Inventor: Nigel Davis, Nottingham (GB)

(73) Assignee: Multi Packaging Solutions UK Limited (GB)

( * ) Notice: Subject to any disclaimer, the term of this patent is extended or adjusted under 35 U.S.C. 154(b) by 548 days.

(21) Appl. No.: 16/893,495

(22) Filed: Jun. 5, 2020

(65) Prior Publication Data

US 2020/0385164 A1 Dec. 10, 2020

(30) Foreign Application Priority Data

Jun. 6, 2019 (GB) ..... 1908094

(51) Int. Cl.
*B65D 5/50* (2006.01)
*B65D 5/02* (2006.01)
(Continued)

(52) U.S. Cl.
CPC ..... *B65D 5/5016* (2013.01); *B65D 5/0236* (2013.01); *B65D 5/0281* (2013.01);
(Continued)

(58) Field of Classification Search
CPC ..... B65D 5/50; B65D 5/44; B65D 5/5028; B65D 5/445; B65D 5/5076; B65D 5/5014;
(Continued)

(56) References Cited

U.S. PATENT DOCUMENTS 2,827,221 A 3/1958 Vines
3,075,683 A * 1/1963 Grossman ..... B65D 5/5045 206/521
(Continued)

FOREIGN PATENT DOCUMENTS

DE 202014007597 U1 10/2014
FR 2853884 A1 10/2004
(Continued)

OTHER PUBLICATIONS

European Search Report dated Oct. 5, 2020, Application No. 20178459.2.
Search Report dated Nov. 22, 2019, Application No. GB1908094.4.

*Primary Examiner* — Andrew D Perreault
(74) *Attorney, Agent, or Firm* — Brian J. Goldberg; Rohini K. Garg

(57) ABSTRACT

A single piece container is provided that is made from cardboard, paperboard or other lightweight foldable sheet material. The container includes an outer shell, an inner shell and at least one spacer tab. The outer shell has a first end and a second end, and includes a plurality of side wall panels hingedly connected to one other about respective outer shell sidewall foldlines and extending between the first end and the second end of the outer shell. The second end of the outer shell is a closed end. The inner shell includes a first end, an opposite second end, and a plurality of side walls hingedly connected to one another about respective inner shell sidewall foldlines and extending between the first end and the second end of the inner shell. The inner shell is integrally connected to the outer shell along a foldline. The at least one spacer tab connects the inner shell and the outer shell, the spacer tab being released from a respective side wall panel of the inner shell. A single piece blank for said container is also provided.

4 Claims, 15 Drawing Sheets

(51) Int. Cl.
*B65D 5/06* (2006.01)
*B65D 81/05* (2006.01)

(52) U.S. Cl.
CPC ..... *B65D 5/06* (2013.01); *B65D 81/05* (2013.01); *B65D 2581/053* (2013.01)

(58) Field of Classification Search
CPC .... B65D 5/5016; B65D 5/0281; B65D 5/103; B65D 5/5021; B65D 5/5023; B65D 5/503; B65D 85/30; B65D 81/113; B65D 81/05; B65D 85/305; B65D 5/0236; B65D 5/06; B65D 2581/053; B65D 5/5004
USPC ..... 206/592, 591, 594, 512
See application file for complete search history.

(56) References Cited

U.S. PATENT DOCUMENTS

| | | | |
|---|---|---|---|
| 3,240,417 | A | 3/1966 | Andreini |
| 5,857,612 | A | 1/1999 | Smith et al. |
| 2017/0057690 | A1 | 3/2017 | Boersma et al. |

FOREIGN PATENT DOCUMENTS

| | | | |
|---|---|---|---|
| JP | S50118231 | | 9/1975 |
| JP | H082521 | A | 1/1996 |
| JP | 2000168763 | A | 6/2000 |
| JP | 3993028 | B2 | 10/2007 |
| JP | 3164694 | U | 12/2010 |
| JP | 5619489 | B2 | 11/2014 |
| JP | 2016060491 | A | 4/2016 |
| JP | 5928890 | B2 | 6/2016 |

* cited by examiner

CONTAINER

TECHNICAL FIELD

The present invention relates to containers made of cardboard, paperboard or other flexible sheet materials. The present invention is particularly concerned with containers of the type including an outer shell and an inner shell.

BACKGROUND

In some contexts containers made of cardboard, paperboard or other flexible sheet materials are provided with a separate inner liner, such as a corrugated cardboard liner. Such a liner may be used, for example, when the container is to hold a fragile item, such as a bottle. The liner may help to provide impact protection for the bottle. However, the erection and assembly of conventional container and inner liner constructions presents some challenges, and requires certain steps to be performed by hand, or multiple stage automation.

The Applicant has realised that there is a need for an improved container and liner construction.

SUMMARY

From a first aspect, the present invention provides a single piece container made from cardboard, paperboard or other lightweight foldable sheet material, the container comprising:

an outer shell having a first end and a second end, and comprising a plurality of side wall panels hingedly connected to one other about respective outer shell sidewall foldlines, the side wall panels extending between the first end and the second end of the outer shell, wherein at least the second end of the outer shell is a closed end;

and an inner shell, wherein the inner shell comprises a first end, an opposite second end, and a plurality of side walls hingedly connected to one another about respective inner shell sidewall foldlines, the side wall panels extending between the first end and the second end of the inner shell, wherein the inner shell is integrally connected to the outer shell along a foldline;

and at least one spacer tab connecting the inner shell and the outer shell, the spacer tab being released from a respective side wall panel of the inner shell. In accordance with the invention, a single piece container is therefore provided. The container is formed from a single piece blank. The container includes an outer shell and an inner shell, wherein the inner shell (e.g. one of the side wall panels thereof) is integrally connected to the outer shell along a foldline. At least one spacer tab is provided which connects i.e. extends between the inner shell and the outer shell, which spacer tab is released from a respective side wall panel of the inner shell.

It has been found that a container of this construction may be more easily and reliably erected, and the erection may be fully automated using a simple process, which may be a single stage process. The erection of the container may be performed entirely by machine. This provides advantages over conventional containers of the type discussed above, whose assembly and erection may require manual steps, or more complex multiple stage automated processes.

The use of one or more spacer tabs to connect the inner shell and the outer shell provides a degree of resilience to the connection between the inner and outer shells. This may provide impact resistance, helping to protect a product when located in the inner shell in use. The container may advantageously be used to house fragile products, such as bottles. The spacer tab(s) also enable the container to be produced in a simple process by machine, with a blank being folded and bonded e.g. glued first, and then erected in a final step, with the spacer tabs helping the folded and glued blank to spring up into an erect configuration. For example, the container may be erected in a single push erecting process.

The container has first and second ends, which may be defined by the first and second ends of the outer shell.

The outer shell may comprise any suitable number of side wall panels, depending upon the desired shape and configuration of the container. In some embodiments the outer shell has four side wall panels, although a greater or lesser number of side wall panels may be used. The first and second ends of the outer shell may provide the first and second ends of the container. The second end of the outer shell is a closed end, and may provide a base of the outer shell. The second end of the outer shell may provide a base of the container.

The inner shell preferably has one side wall panel for each one of the side wall panels of the outer shell. Thus, the inner shell and outer shell preferably have the same number of side wall panels.

The side wall panels of the inner shell may be of the same or differing size and shape. For example, the side wall panels may include panels of differing widths and/or heights. The height of a panel of the inner shell as used herein refers to the dimension of the panel in the direction along the direction extending between the first and second ends of the inner shell. The most appropriate shape and size of the side wall panels of the shell may depend upon the configuration of a product to be located in the shell.

The container may be a square or rectangular container, although other configurations may be envisaged e.g. hexagonal, octagonal etc. The shape of the container will be defined by the shape of the outer shell, which may therefore be of any such shapes. In some embodiments the side wall panels of the outer shell are rectilinear e.g. square or rectangular. In some embodiments the inner shell may be square or rectangular. The inner shell may be of the same shape as the outer shell, although this need not be the case. For example, the inner shell may be square while the outer shell/container is rectangular. It is not necessary that the side wall panels of the inner shell are rectilinear. For example, one or both ends of at least some of the panels may be curved.

The inner shell and outer shell may each comprise a plurality of pairs, e.g. two or more pairs, of opposed side wall panels.

At least one spacer tab is provided connecting the inner shell and outer shell. The spacer tab(s) help to retain the inner shell in a desired position relative to the outer shell. The spacer tab(s) provide some degree of resilience, enabling the inner shell to help cushion a product located therein in use, and protect the product against multi-directional impact. The spacer tab(s) may also help to facilitate erection of a folded blank to provide the container using a simple automated process.

The or each spacer tab is released from a respective side wall panel of the inner shell. Any suitable number of spacer tabs may be provided to appropriately support the inner shell in a desired position relative to the outer shell. The most appropriate number of spacer tabs will depend upon factors such as the shape of the inner shell and/or outer shell and the intended content of the container. Where the container is square or rectangular, for example, it is envisaged that from 1 to 3 spacer tabs might typically be used, for example 2 spacer tabs, although a greater number may be envisaged.

Preferably a plurality of spacer tabs are provided being released from different respective side wall panels of the inner shell. The inner shell may comprise a plurality of pairs of opposed side wall panels. Two or more such pairs of opposed side wall panels may be provided. In some embodiments only two pairs of opposed side wall panels are provided. In embodiments in which the inner shell comprises a plurality of pairs of opposed side wall panels, preferably spacer tabs are provided which are released from respective ones of a pair of opposed side wall panels of the inner shell. Spacer tabs may be provided released from only one, or a plurality of pairs of the plurality of pairs of opposed side wall panels of the inner shell.

In embodiments, only one spacer tab is released from any given one of the side wall panels of the inner shell. However, other arrangements may be envisaged using multiple spacer tabs released from one or more of the side wall panels.

The base of the or each spacer tab provided may extend from an edge of a side wall panel of the inner shell adjacent the side wall panel from which the spacer tab is released. The base of the tab may interrupt a foldline connecting the side wall panel from which the tab is released and the adjacent side wall panel. In these embodiments, no foldline is provided between the base of the tab and the adjacent side wall panel (to that from which the tab is released).

The or each spacer tab may connect the inner shell (e.g. an edge of a side wall panel of the inner shell adjacent the side wall panel from which the spacer tab is released) to a side wall panel of the outer shell.

Each spacer tab may have a connecting portion extending between the inner shell and the outer shell and an attachment portion attached to the outer shell. The attachment portion may be bonded to the outer shell in any suitable manner e.g. using adhesive or heat sealing. The connecting and attachment portions are proximal and distal portions of the spacer tab respectively. The connecting portion extends from a base of the tab. The connecting portion and attachment portion may be connected to one another about a foldline. The connecting portion may extend from an edge of a side wall panel of the inner shell adjacent the side wall panel from which the spacer tab is released to a base of the attachment portion e.g. to a foldline connecting the connecting portion to the attachment portion.

The shape and size of each spacer tab may be selected as desired, and the or each spacer tab provided may or may not be of the same shape and size.

The inner shell is integrally connected to the outer shell along a foldline. The connection may be between any one of the components e.g. panels or flaps of the inner shell and any one of the components e.g. panels or flaps of the outer shell.

Preferably one of the side wall panels of the inner shell is integrally connected to the outer shell along the foldline. For the avoidance of doubt, "the" foldline here refers to the foldline along which the inner and outer shells are integrally connected. The foldline may extend a direction parallel to the direction of the foldlines connecting the side wall panels of the inner shell or outer shell. The foldline may extend in a direction connecting the first and second ends of the outer shell i.e. in the direction of the height of the inner and outer shell side wall panels.

The side wall panel may comprise a connecting portion which connects the inner shell to the outer shell. The connecting portion is connected to the outer shell along the foldline at one end thereof (e.g. a distal end thereof). The connecting portion may extend from an edge of an adjacent side wall panel of the inner shell (e.g. at a proximal end of the connecting portion). The adjacent side wall panel is the side wall panel adjacent to the side wall panel which is connected to the outer shell along the foldline i.e. the side wall panel having the connecting portion. In embodiments, no foldline is provided between the connecting portion of the side wall panel having the connecting portion and a remainder of that side wall panel.

The inner shell (or, more specifically, in preferred embodiments, the side wall panel thereof that is connected to the outer shell along the foldline) may be connected to any suitable component e.g. panel or flap of the outer shell along the foldline.

The inner shell, or, more specifically, in preferred embodiments, the side wall panel thereof is, in embodiments, connected to a glue flap of the outer shell along the foldline. In preferred embodiments in which a side wall panel of the inner shell is integrally attached to the outer shell along the foldline, the outer shell comprises an outer shell glue flap connected along a foldline to one of the side wall panels of the outer shell and which outer shell glue flap is attached to the interior of an adjacent side wall panel of the outer shell to retain the outer shell in an erect configuration, and the side wall panel of the inner shell which is integrally connected to the outer shell along the foldline (e.g. a connecting portion thereof) is integrally connected along a foldline to a distal edge of the outer shell glue flap. The outer shell glue flap may be bonded to the interior of the adjacent side wall panel e.g. adhesively or using heat sealing. Thus, the foldline along which the inner shell, or, in embodiments, a side wall panel of the inner shell (e.g. a connecting portion thereof) is integrally connected to the outer shell connects the side wall panel of the inner shell to a distal edge of the outer shell glue flap. In accordance with the invention, the components e.g. flaps and panels required to provide the inner shell may simply be provided by an extension (e.g. from the glue flap of the outer shell) of a blank for providing the outer shell.

The outer shell glue flap extends from the side wall panel of the outer shell to which it is connected along a foldline towards an opposed side wall panel of the outer shell along the interior of the adjacent side wall panel. The adjacent side wall panel connects the opposed side wall panels. Preferably the outer shell glue flap extends over only a portion of the distance between the opposed side wall panels. This may enable a side wall panel of the inner shell which is connected to the distal end of the glue flap along a foldline to be spaced by a desired distance from the opposed side wall panel of the outer shell.

The inner shell may comprise an inner shell glue flap connected along a fold line to one of the side wall panels of the inner shell, which inner shell glue flap is attached e.g. bonded (such as using adhesive or heat sealing) to another side wall panel of the inner shell to retain the inner shell in an erect configuration. In embodiments in which a side wall panel of the inner shell is integrally connected to the outer shell along a foldline, the inner shell may comprise an inner shell glue flap connected along a fold line to one of the (other) side wall panels of the inner shell, which inner shell glue flap is attached e.g. bonded (such as using adhesive or heat sealing) to the side wall panel of the inner shell that is integrally connected to the outer shell along a foldline to retain the inner shell in an erect configuration. Where the side wall panel of the inner shell that is integrally connected to the outer shell along a foldline comprises a connecting portion, the inner shell glue flap may be attached to the connecting portion thereof. Such arrangements may facilitate folding and bonding e.g. gluing of a blank used to form the container, as described in more detail below. The connecting portion of the inner shell side wall panel may have a width which is at least as great as a width of the inner shell glue flap. The inner shell glue flap may extend over the entire height of the connecting portion. The inner shell glue flap may extend over the entire connecting portion. The inner shell glue flap may be attached to the side wall panel of the inner shell adjacent the foldline connecting the side wall panel to the outer shell. The inner shell side wall panel having the inner shell glue flap connected thereto along a foldline and the side inner shell wall panel that is integrally connected to the outer shell are adjacent side panels of the inner shell. The inner shell glue flap may be connected along a fold line to that side wall panel from the edge of which the connecting portion extends.

A tab may be released from the side wall panel of the inner shell to which the inner shell glue flap is connected along a foldline, the tab having a base which extends from a proximal edge of the inner shell glue flap. The tab may be attached e.g. adhered to the interior of the inner shell side wall panel to which the inner shell glue flap is attached (e.g. the inner shell side wall panel having a connecting portion). The base of the tab may interrupt the foldline connecting the inner shell glue flap to the side wall panel from which it extends. Thus, in embodiments, no foldline is provided between the base of the tab and the proximal edge of the inner shell glue flap from which it extends. The tab may extend over only a portion of the height of the side wall panel of the inner shell to which it is attached. The tab may have a height less than a height of the inner shell glue flap.

The tab may extend into the interior of the inner shell. The tab may be attached e.g. bonded (such as using adhesive or heat sealing) to the side wall panel of the inner shell so as to extend inwardly from the edge of an adjacent side wall panel. Thus, in embodiments in which the side wall panel has a connecting portion extending from an edge of the adjacent side wall panel of the inner shell at a proximal end thereof, the tab and the connecting portion may extend in opposite directions from the edge of the adjacent side wall panel. Such arrangements may facilitate folding and bonding of a blank and its subsequent erection to provide the container. The tab may help to reinforce the inner shell structure.

In any of the embodiments of the invention, the inner shell comprises a first end and an opposite second end. In embodiments the first and second ends are both open ends. The inner shell may be in the form of a sleeve. The inner shell provides a liner for the outer shell within which product may be disposed in use.

The side wall panels of the inner shell preferably do not extend over the whole height of the side wall panels of the outer shell. The second (i.e. bottom) ends of the side wall panels of the inner shell may be spaced from the base of the outer shell. The first (i.e. top) ends of the side wall panels of the inner shell may be spaced from the first (i.e. top) end of the outer shell.

At least the second end of the opposed first and second ends of the outer shell is a closed end. The second end may provide a closed base of the outer shell and hence container. Any suitable closure structure may be used e.g. a lid structure or end panel as described below. The second end may or may not be bonded (e.g. using adhesive or heat sealing) in its closed configuration. For example, a lid structure may be used to close the second end. The lid structure may be of the same type described below in relation to the first end of the container. The lid structure may provide a releasable and refastenable closure. Alternatively the second end of the outer shell may be bonded closed (e.g. using adhesive or heat sealing). For example, an end panel (i.e. bottom panel) may be provided which is bonded to underlying end flaps to close the second end. Such an end panel may be bonded to end flaps associated with the second ends of opposed side wall panels of the outer shell. The end flaps may be connected to the respective opposed side wall panels of the outer shell along respective foldlines.

The first end of the outer shell may be the end through which a product located in the container is intended to be initially viewed or withdrawn in use (the end through which a product is withdrawn may depend upon the shape of the product and any cooperating product support features). This end may be referred to as the "top" end of the container, although this does not imply any required orientation of the container in use. The first or "top" end refers to the end opposite to the second or bottom end of the outer shell (or container) which may define a base for the container. However, it will be appreciated that this again does not imply any particular orientation of the container in use, and terms such as "top", "bottom", and base are used merely to distinguish the ends of the container/inner shell/outer shell from one another for the purposes of illustrating certain features of the invention.

The first end of the outer shell may be a closed end. As with the second end, the first end of the container may or may not then be bonded in its closed configuration. Any suitable end closure structure may be used. Generally the end closure may comprise an end panel or lid panel and a pair of end flaps underlying the end panel or lid panel.

The first end of the outer shell may comprise a lid structure for releasably and refastenably closing the first end of the container. The lid structure may comprise at least a lid panel having a closure flap connected thereto along a foldline. A pair of end flaps may be associated with opposed side wall panels of the outer shell at the first end thereof. The end flaps are folded under the lid panel when the lid structure is in a closed configuration. The end flaps are connected along respective foldlines to the first ends of the opposed side wall panels.

Where a lid structure is provided at the second end of the outer shell, it may be of the same construction as described in relation to the first end (whether or not a lid structure is also provided at the first end).

Alternatively the first end of the outer shell may be bonded (e.g. using adhesive or heat sealing) in a closed configuration. For example, an end panel (i.e. top panel) may be provided which is bonded to underlying end flaps to close the first end. Such an end panel may be bonded to opposed end flaps associated with the first ends of opposed side wall panels of the outer shell. The end flaps may be connected to the respective opposed side wall panels along respective foldlines. Bonding of the first end in a closed configuration may provide a sealed container, enabling a shrink wrap to be dispensed with. In these embodiments, the end panel may be of the same construction as the lid panel in the releasable and refastenable configurations, but with the closure flap omitted.

Where the first end of the outer shell is bonded in a closed configuration, a refastenable closure feature may be provided to enable the outer shell to be refastenably closed after initial opening of the first end of the outer shell. The refastenable closure feature may be associated with the opposed end flaps. The refastenable reclosure arrangement may include cooperating parts associated with each of the opposed end flaps for releasably interlocking the end flaps together. The cooperating parts may comprise: a locking tab associated with one of the opposed end flaps and an opening associated with the other of the opposed end flaps, wherein the opening is configured to receive the locking tab for releasably interlocking the opposed end flaps together.

It will be appreciated that any combination of bonded and releasable closures may be used at the ends of the product e.g. a releasable and refastenable lid structure at the first end and a bonded closure at the second end. Where a bonded closure is provided at either end of the outer shell, a refastenbale closure feature may be provided in respect of that end. It is also envisaged that the first end may be an open end, with no closure feature.

The container of the present invention may be used to receive any type of product. The product is located within the inner shell in use. The present invention extends to a container in accordance with the invention in any of its aspects or embodiments having a product located therein. The product may be a container, e.g. a bottle, such as a perfume bottle. However this is only one example of the type of product which may be held by the container. The container is particularly useful in conjunction with fragile products where it is desired to protect the product from impact. Product may be loaded into the inner shell from either end, depending upon the configuration of any product support features, with the applicable end of the outer shell then being closed.

The inner and/or outer shells of the container may include any suitable features to assist in supporting the product in the container. It will be appreciated that any combination of the product supporting features described below may be used, to the extent that they are not mutually exclusive or otherwise incompatible. One or more, and preferably a plurality of the side wall panels of the inner shell may comprise a respective product support flap connected to a first end thereof along a foldline. Preferably each one of at least one pair of opposed side wall panels of the inner shell comprises a respective product support flap connected to a first end thereof along a foldline. In some embodiments each one of the side wall panels of the inner shell may comprise such a product support flap.

Where multiple product support flaps are provided associated with different ones of the side wall panels of the inner shell, the flaps may be of the same or differing shape and size. The flaps may be rectilinear or non-rectilinear in shape, and flaps of both rectilinear and non-rectilinear shape may be provided.

In some embodiments a distal edge of each one of at least one pair of the opposed product support flaps (of the at least one pair of opposed product support flaps) may comprise means for locating a product e.g. a neck of a bottle in use. The locating means may comprise a recess. The locating means of the opposed flaps may provide a collar for the product. Where multiple pairs of opposed product support flaps are provided one or more of the pairs of opposed product support flaps may comprise such a feature. For example, only one such pair, or each pair of opposed product support flaps may include such a feature.

In some embodiments, for at least some of the inner shell side wall panels having a product support flap connected along an end thereof along a foldline, a lug is provided, the lug being released from the side wall panel, and the base of the lug extending from the proximal edge of the product support flap. In this way, rotation of the product support flap outwardly about the foldline connecting the product support flap to the side wall panel will result in movement of the lug so as to extend into the interior of the outer shell. This may help to locate a product within the inner shell, and inhibit lateral movement of the product as a result of impact. The base of the lug may interrupt the foldline connecting the product support flap to the side wall panel. In these embodiments, no foldline is provided between the base of the lug and the product support flap.

One or more of the side wall panels of the inner shell may alternatively or additionally comprise a respective product support flap connected to a second end thereof along a foldline. The or each product support flap may be in accordance with any of the embodiments described in relation to such a flap at the first end of the side wall panels.

In some embodiments the outer shell comprises product support flaps at one or both ends thereof. The product support flaps may extend into the interior of the outer shell. In embodiments in which the first end of the outer shell is a closed end, a panel of the closure structure e.g. a lid panel or end panel may cooperate with the flaps to hold them in a position such that they extend substantially parallel to a base of the outer shell for cooperating with a product in use. The product support flaps may provide the end flaps associated with a closure structure e.g. lid structure.

One or more, and preferably a plurality of the side wall panels of the outer shell may comprise a respective product support flap connected to one or both ends thereof along a foldline. Preferably, at one or both ends of the outer shell, each one of a pair of opposed side wall panels of the outer shell comprises a respective product support flap connected to an end thereof along a foldline. It will be appreciated that where product support flaps are provided at both ends of the outer shell, these may be associated with the same or different pairs of the opposed side wall panels. Product support flaps may be associated, at either end of the outer shell, with one or more pairs of opposed side wall panels of the outer shell.

In some embodiments each product support flap comprises a first panel connected at a proximal end of the first panel along a foldline to the end of the side wall panel, a second panel connected at a proximal end of the second panel along a foldline to the distal end of the first panel, a third panel connected at a proximal end of the third panel along a foldline to the distal end of the second panel, and a fourth panel connected at a proximal end of the fourth panel along a foldline to the distal end of the third panel, the fourth panel being attached (e.g. bonded, such as using adhesive or heat sealing) to the interior of the side wall panel, and wherein the second panel spaces the first and third panels from one another. Such an arrangement may provide a three-dimensional product support flap which may act as a cushion to better protect a product located within the outer shell from impact at the applicable end of the container. The fourth panel is attached to the side wall panel below, and optionally at a location spaced from, the foldline along which the proximal end of the first panel is connected to the side wall panel. The first and third panels may be of the same length. The first and third panels may extend generally parallel to one another. Where the fourth panel of the product support flap is attached to a side wall panel to which an outer shell glue flap is also attached, the glue flap may comprise a recess at the corresponding end thereof to enable the fourth panel to be directly attached to the interior of the side wall panel. In accordance with the invention in any of its embodiments, one or more of the side wall panels of the inner shell may comprise an opening at the second end thereof for locating a product when disposed in the inner shell in use. The opening is spaced from the edge of the panel at the second end thereof. Each one of at least one pair of opposed side wall panels of the inner shell may comprise such a product locating opening, and, in some embodiments, each one of the side wall panels of the inner shell comprises a product locating opening at the second end thereof. The edges of a base of a product may be located in the openings to suspend the product above the base of the outer shell.

In accordance with the invention in any of its embodiments, a product supporting strip may extend between opposed side wall panels of the inner shell at the second end thereof. An edge of the product supporting strip toward the first end of the inner shell e.g. an upper end of the strip may be used alone to support (the base) of a product located in the inner shell in use. However, in some embodiments a product supporting flap may be connected to the product supporting strip along a foldline to provide a platform for supporting a product located in the inner shell in use. The product supporting strip may extend between foldlines connecting the respective ends thereof to the opposed side panels. The foldlines are located between the edges of the respective side panels, such as at a mid-point between the edges.

The product supporting strip may be defined by a cutline extending across a foldline connecting adjacent ones of the side wall panels of the inner shell. In some embodiments the product supporting strip may be provided by a first portion of a strip defined by a cutline extending across a foldline connecting adjacent ones of the side wall panels, a second portion of the strip defined by the cutline being attached (e.g. bonded, such as using adhesive or heat sealing) to one of the opposed side wall panels at the second end thereof e.g. at the base thereof. The first portion of the strip defined by the cutline may be defined between a first foldline connecting the strip to one of the adjacent panels and a second foldline which separates the first and second portions of the strip defined by the cutline. The second portion of the cutline may extend from the second foldline to an edge of the other one of the adjacent side wall panels. The edge may be an edge of the side wall panel which is connected along a foldline to an inner shell glue flap.

It will be appreciated that product support features of any of the types described, whether associated with the inner shell or outer shell, or both, may be used alone or in any combination, at one or both ends of the container as appropriate, to the extent that they are not mutually exclusive. Thus, any combination of the following may be used; inner shell product support flaps, outer shell product support flaps, openings in second end of inner shell, product supporting strip, outer shell platform end flaps and product locating means.

The present invention extends to a blank for providing the container in accordance with any of the embodiments herein described. The blank is a single piece blank.

In accordance with a further aspect of the invention there is provided a single piece blank made from cardboard, paperboard or other lightweight foldable sheet material, the blank being erectable to provide a container having an outer shell and an inner shell, the blank comprising:

an outer shell sub-assembly comprising;

a set of outer shell side wall panels connected to each other about respective outer shell side wall panel foldlines for providing the side walls of an outer shell, at least one end panel for closing an end of the outer shell, and an outer shell glue flap connected to one of the outer shell side wall panels along a foldline;

an inner shell sub-assembly comprising;

a set of inner shell side wall panels connected to each other about respective inner shell side wall panel foldlines for providing the side walls of an inner shell, and an inner shell glue flap connected to one of the inner shell side wall panels along a foldline;

wherein the inner shell sub-assembly is integrally connected to the outer shell sub assembly along a foldline, preferably wherein one of the inner shell side wall panels is integrally connected to the outer shell sub assembly along the foldline;

the blank further comprising at least one spacer tab for connecting the inner shell and the outer shell when the blank is erected, the or each spacer tab being released from a respective inner shell side wall panel.

The inner and outer shell side wall panels may be for providing a plurality of e.g. first and second pairs of opposed side wall panels of the inner and outer shell respectively when the blank is erected. The spacer tab(s) may be considered to form part of the inner shell sub-assembly.

The end panel may provide a closed second end of the outer shell. The end panel may or may not have a closure flap connected thereto along a foldline, depending whether the end is to be bonded closed or include a releasable lid structure. A pair of opposed end flaps may be provided to form part of an end closure structure together with the end panel.

A plurality of spacer tabs may be provided, being released from different respective inner shell side wall panels, wherein spacer tabs are provided which are released from respective ones of the inner shell side wall panels which will form a pair of opposed side wall panels of the inner shell when the blank is erected.

A base of the spacer tab may extend from an edge of an inner shell side wall panel adjacent the inner shell side wall panel from which the spacer tab is released, optionally wherein the spacer tab interrupts a foldline connecting the inner shell side wall panel to the adjacent inner shell side wall panel.

Each spacer tab present may have a connecting portion for extending between the inner shell and the outer shell when the blank is erected and an attachment portion for attachment to the outer shell, the connecting and attachment portions being connected to one another about a foldline.

The inner shell side wall panel which is integrally connected to the outer shell sub-assembly along a foldline may comprise a connecting portion connected to the outer shell along the foldline to which the inner shell glue flap may be attached during erection of the blank, optionally wherein the connecting portion has a width which is at least as great as a width of the inner shell glue flap.

The foldline along which the inner shell sub-assembly is integrally connected to the outer shell sub-assembly preferably connects a side wall panel of the inner shell sub-assembly to the outer shell sub-assembly, and may connect the inner shell side wall panel to a distal edge of the outer shell glue flap.

The outer shell glue flap may have a width which is less than a width of the outer shell side wall panel to which it is attached in erecting the container.

A tab may be released from the inner shell side wall panel to which the inner shell glue flap is connected along a foldline, the tab having a base which extends from a proximal edge of the inner shell glue flap.

At least some of the inner shell side wall panels may comprise a respective product support flap connected to an end thereof along a foldline.

For at least some of the inner shell side wall panels having a product support flap connected along an end thereof along a foldline, a lug may be provided, the lug being released from the side wall panel, and the base of the lug extending from the proximal edge of the product support flap.

At one or both ends of the outer shell sub-assembly, each one of a pair of opposed outer shell side wall panels may comprise a respective product support flap connected to an end thereof along a foldline.

Each product support flap may comprise a first panel connected at a proximal end thereof along a foldline to the end of the side wall panel, a second panel connected at a proximal end thereof along a foldline to the distal end of the first panel, a third panel connected at a proximal end thereof along a foldline to the distal end of the second panel, and a fourth panel connected at a proximal end thereof along a foldline to the distal end of the third panel, optionally wherein the first and third panels are of equal length.

The inner shell sub-assembly may comprise a cutline extending across a foldline connecting adjacent ones of the side wall panels and defining a product supporting strip. A product supporting flap may be connected to the product supporting strip along a foldline.

In accordance with the invention in any of its aspects or embodiments, the product support is made from a foldable sheet material such as paperboard or cardboard, or even a plastics material. The material may be chosen as desired.

A fold line as referred to herein refers to any line about which components have been folded. The fold line may comprise a line of weakness, crease line and/or perforations. If not explicitly stated, and unless inconsistent therewith, any connection described herein may be about a fold line.

Any reference to a height refers to a dimension as measured in the direction extending between the first and second ends of the outer shell (or inner shell or container as appropriate). A width of a side wall panel is measured in the direction connecting the opposed edges of the side wall panel. The width dimension may be measured in a direction perpendicular to a direction connecting the first and second ends of the outer shell/inner shell/container.

The present invention in accordance with any of its further aspects or embodiments may include any of the features described in reference to other aspects or embodiments of the invention to the extent it is not mutually inconsistent therewith.

BRIEF DESCRIPTION OF DRAWINGS

Some preferred embodiments of the invention will now be described by way of example only and with reference to the followings drawings, of which.

DETAILED DESCRIPTION

Figure 1:
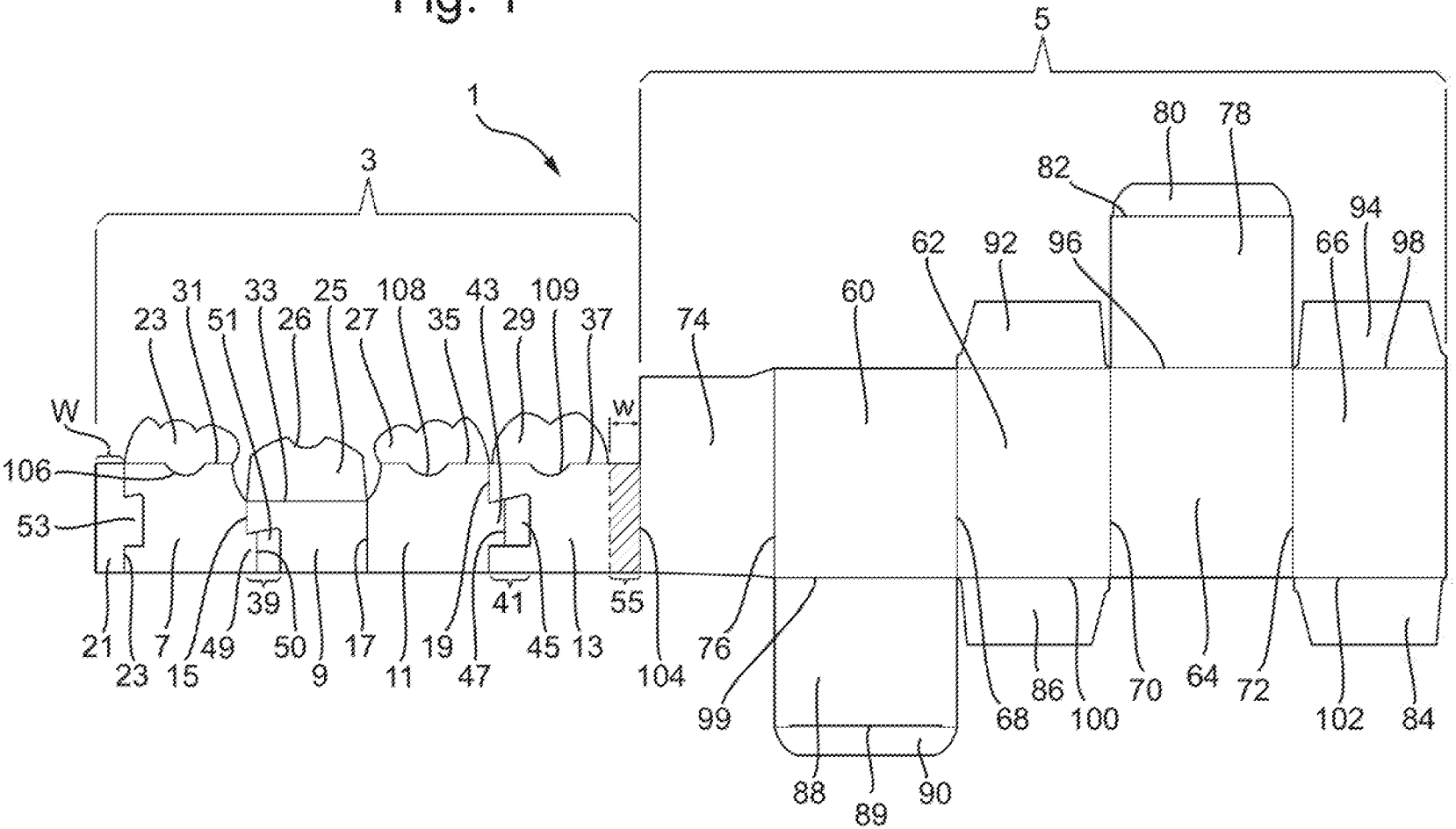
FIG. 1 shows a blank in the flat for forming a container in accordance with a first embodiment of the present invention.

With reference to FIG. 1, a blank for providing a container in accordance with a first embodiment of the invention will now be described.

FIG. 1 shows the blank in the flat from above, from the side which will provide the exterior surfaces of the inner and outer shells in the erected container.

The blank 1 includes an inner shell sub-assembly 3 for providing an inner shell of the container and an outer shell sub-assembly 5 for providing an outer shell of the container.

The inner shell sub-assembly includes inner shell side wall panels 7, 9, 11, 13. Inner shell side wall panels 7, 9, 11 and 13 are connected by respective foldlines 15, 17, 19. An inner shell glue flap 21 is connected along a foldline 23 to the inner shell side panel 7. Product support flaps 23, 25, 27, 29 are connected by foldlines 31, 33, 35, 37 to the first ends of the panels 7, 9, 11, 13 respectively which will be at the upper end of the inner shell in the erected container. The upper edges of the product support flaps are, in this embodiment, shown as having various shapes incorporating curved sections, to provide an aesthetically pleasing appearance. These configurations are merely exemplary.

Lugs 106, 108, 109 are released from the side wall panels, 7, 11, 13. The base of each lug extends from the product support flap adjacent the respective side wall panel from which the lug is released. The lug interrupts the foldline connecting the product support flap to the side wall panel. Product support flap 25 includes a recess 26 in its upper edge to help support a product e.g. a bottle neck in use.

In the embodiment illustrated, the height of the side wall panel 9 differs from that of the remaining inner shell side wall panels to enable the recess 26 to be appropriately located with respect to a product with which the container is intended to be used. It will be appreciated that the relative dimensions of the side wall panels and/or product support flaps may differ from that shown, and may be selected by reference to a product with which the container is intended to be used to e.g. provide a desired aesthetic and support function.

Spacer tabs 39, 41 are released respectively from inner shell side wall panels 9 and 13. The base of each spacer tab 39, 41 extends from the edge of the respective side wall panel 7, 11 which is adjacent the respective panel 9, 13 from which the tab are released. Each spacer tab includes a respective connecting portion 49, 43, which will extend between the inner and outer shells in the erected container, and an attachment portion 51, 45, which is bonded to the interior of the outer shell in the erected container. The connecting and attachment portions of the spacer tabs 39, 41 are separated by respective foldlines 50, 47. The tabs 39, 41 interrupt the foldlines 15, 19 respectively.

A tab 53 is released from the side wall panel 7, and has a base extending from the proximal edge of the glue flap 21. The tab 53 interrupts the foldline 23.

The side wall panel 13 includes a connecting portion 55 which is indicated in hatched lines. It will be appreciated that this is merely an extension of the side wall panel 13, and the hatching is for illustration purposes only, and does not imply any structural features distinguishing the connecting portion 55 from the remainder of the panel 13.

The width w of the connecting portion 55 and the width W of the inner shell glue flap 21 are selected appropriately to enable the glue flap 21 to be bonded to the connecting portion 55 during erection of the blank.

The outer shell sub-assembly 5 includes outer shell side wall panels 60, 62, 64, 66 connected by foldlines 68, 70, 72. The outer shell sub-assembly also includes an outer shell glue flap 74, connected along a foldline 76 to the outer shell side wall panel 60.

The outer shell sub-assembly includes a lid (end) panel 78 connected to the side wall panel 64 along a foldline 96, and a closure flap 80 connected along a foldline 82 to the lid panel 78, which, together with end flaps 92, 94 (which are connected to the side wall panels 64, 66 along respective foldlines 96, 98) provide a releasable closure for the first (upper) end of the outer shell.

The outer shell sub-assembly similarly includes a lid (end) panel 88 connected to the outer shell side wall panel 60 along foldline 99, closure flap 90 connected to the lid panel 88 along a foldline 89, and a pair of end flaps 86, 84 connected to the side wall panels 62, 66 along respective foldlines 100, 102 at a second (lower) end thereof, for providing a releasable and refastenable closure at the second end of the outer shell.

The connecting portion 55 of the inner shell side wall panel 13 is connected to the outer shell glue flap 74 along a foldline 104, thereby connecting the inner and outer shell sub-assemblies 3, 5.

The way in which the blank 1 is used to provide a container will now be described by reference to FIGS. 2-7.

Figure 2:
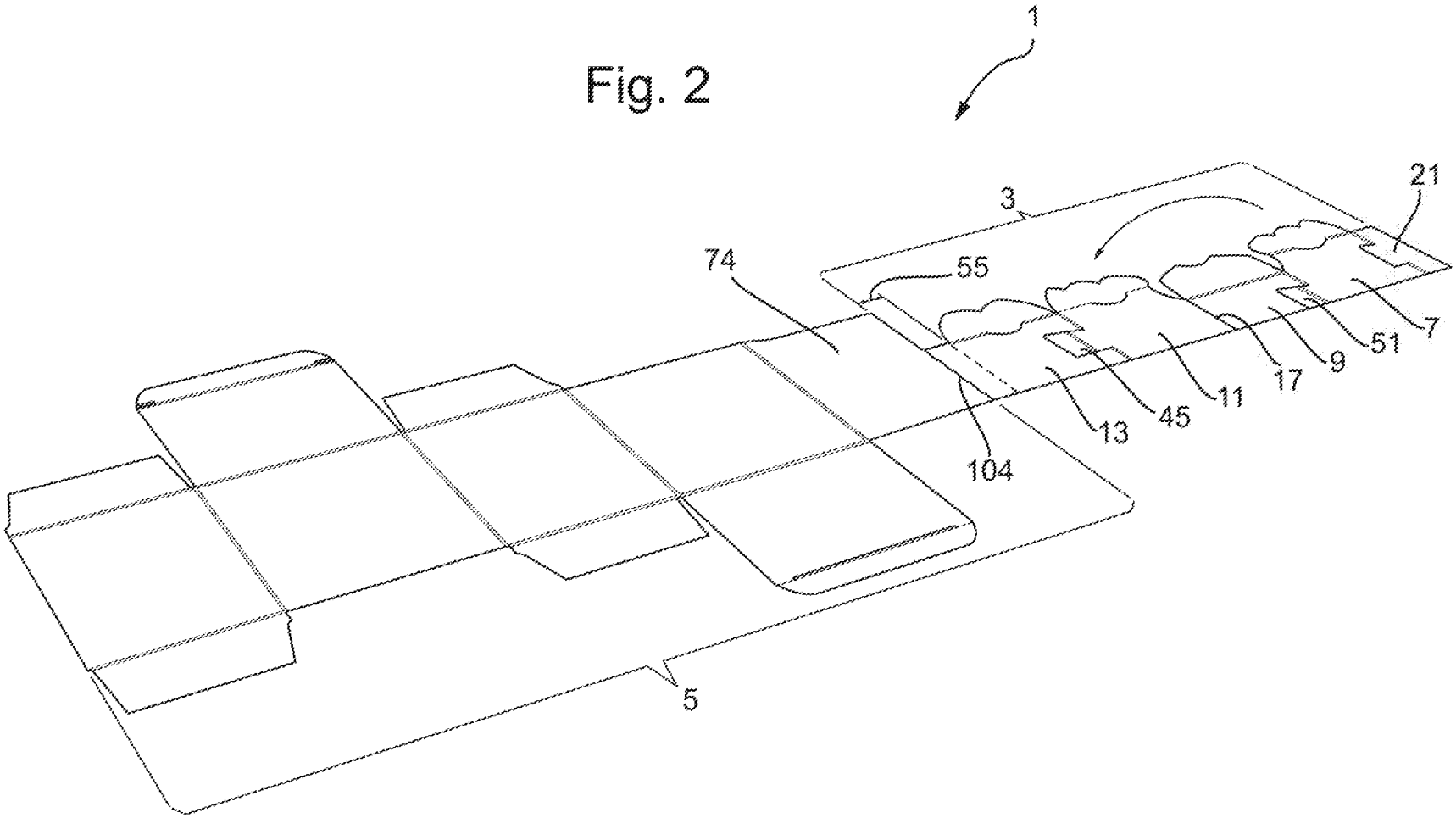
FIG. 2 illustrates the blank of FIG. 1 in the flat, but with the opposite surface uppermost.

FIG. 2 illustrates the blank in the flat from above, with the surface which will be located to the interior of the container uppermost.

In a first step, adhesive is applied to the surface of the inner shell glue flap 21 that is uppermost in FIG. 2. The inner shell sub-assembly 3 is then folded about the foldline 17 in the direction of the arrow shown in FIG. 2 to place the inner shell side wall panels 7, 9 on top of the inner shell side wall panels 11,13 respectively, with the inner shell glue flap 21 on top of the connecting portion 55. The adhesive applied to the glue flap 21 adheres the glue flap to the connecting portion 55 of side wall panel 13. The folded blank after this step is shown in the flat in FIG. 3.

Figure 3:
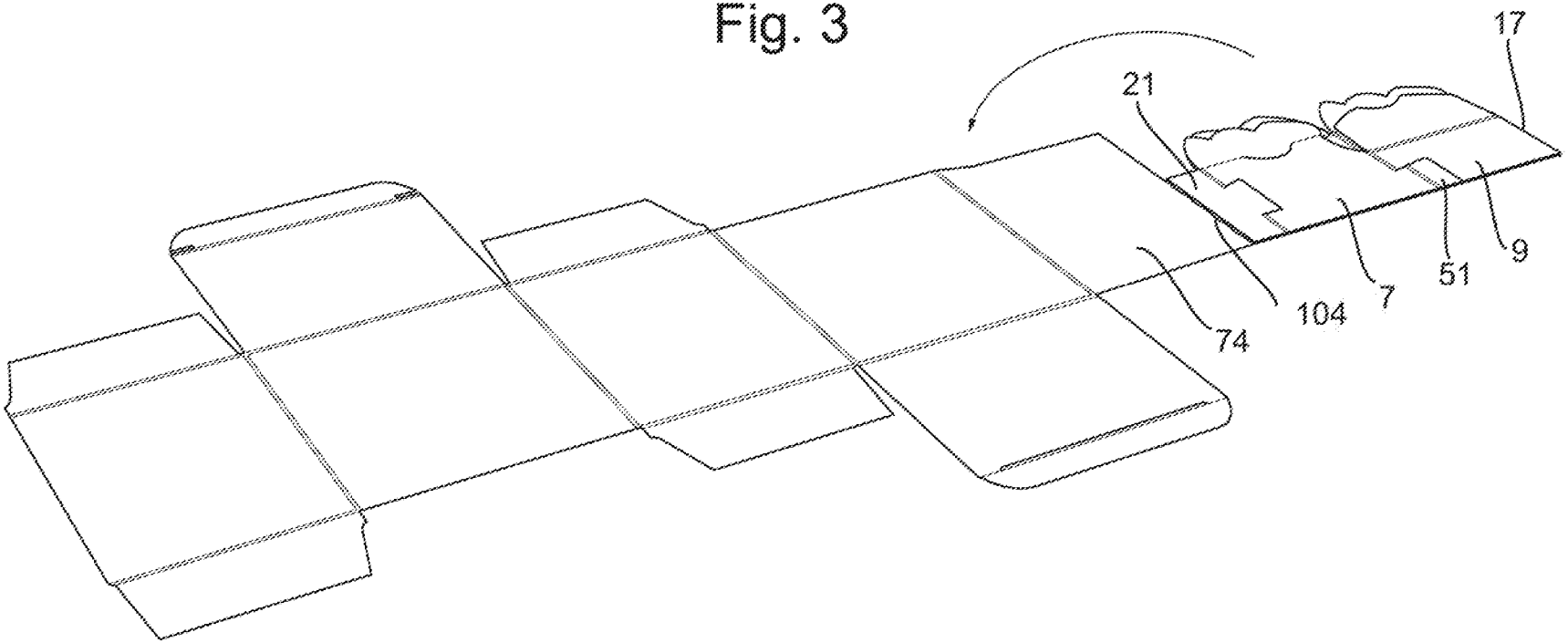
FIG. 3 illustrates the blank of FIG. 2 after a first folding step in a flat configuration.
Figure 3A:
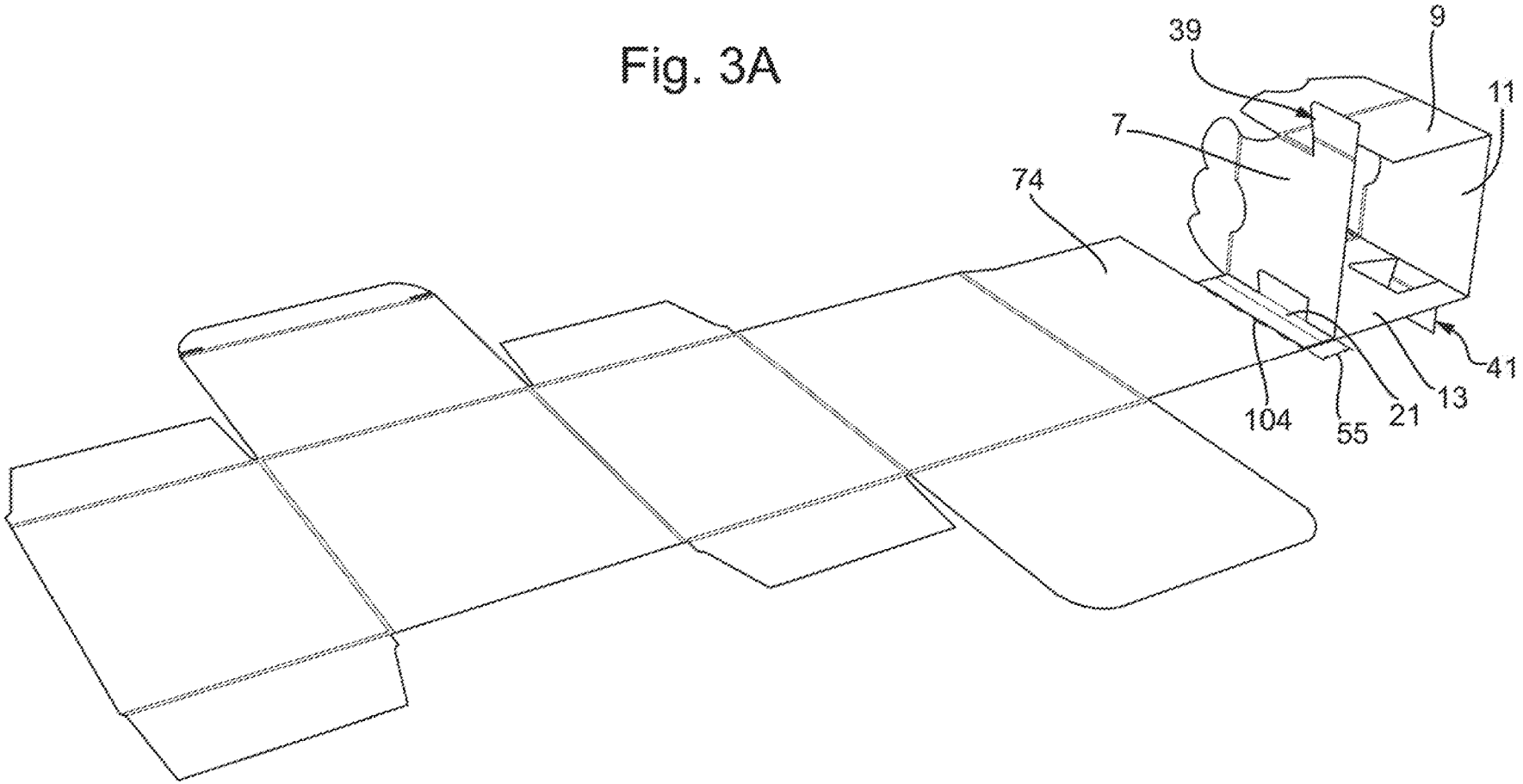
FIG. 3A illustrates the folded blank of FIG. 3 but in an erect configuration for the purposes of illustrating certain features of the folded blank.

FIG. 3A illustrates the folded blank as shown in FIG. 3 in an erect configuration. This illustrates the way in which the inner shell glue tab 21 is adhered to the connecting portion 55 of inner shell side wall panel 13. It is envisaged that all steps involved in folding and gluing the blank described with respect to FIGS. 2-6 may advantageously be carried out in the flat, with the blank then being erected (i.e. converted to a 3-dimensional configuration) after all folding and gluing is complete. FIGS. 3A, 4A, 5A facilitate understanding of the arrangement of the various parts of the blank after each folding/gluing stage, and show the erected blank from the second (bottom) end. However, it will be appreciated that, in preferred embodiments in which all steps involved in folding and gluing the blank are carried out in the flat, the blank will not be erected at any of the intervening stages, and thus FIGS. 3A, 4A and 5A do not correspond to any configurations which would exist as part of the process of producing the container.

In the next step, adhesive is applied to surface of the attachment portion 51 of spacer tab 39 which lies uppermost in FIG. 3. The folded inner shell sub-assembly as shown in FIG. 3 is then folded about the foldline 104 connecting the inner shell sub-assembly to the outer shell sub-assembly in the direction of the arrow shown in FIG. 3 to the position shown in FIG. 4, in which the folded inner shell sub-assembly is superposed on the side wall panel 60 of the outer shell and the outer shell glue flap 74. The adhesive applied to the attachment portion 51 of spacer tab 39 bonds the tab to the outer shell side wall panel 60. FIG. 4A illustrates the folded and glued blank of FIG. 4 in an erect configuration. This illustrates the bonding of the inner shell spacer tab 51 to the side wall panel 60 of the outer shell.

Figure 4:
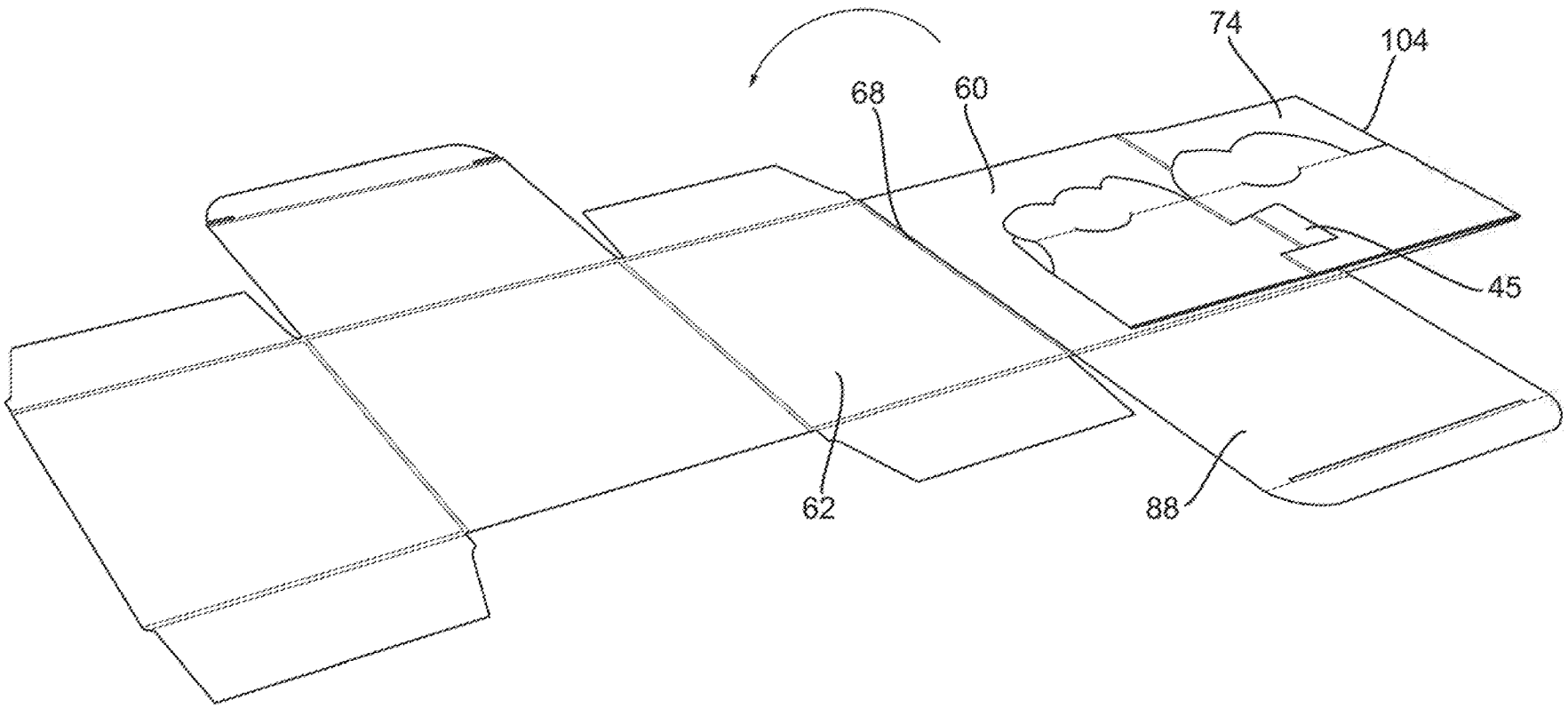
FIG. 4 illustrates the blank of FIG. 2 after a second folding step in a flat configuration.
Figure 4A:
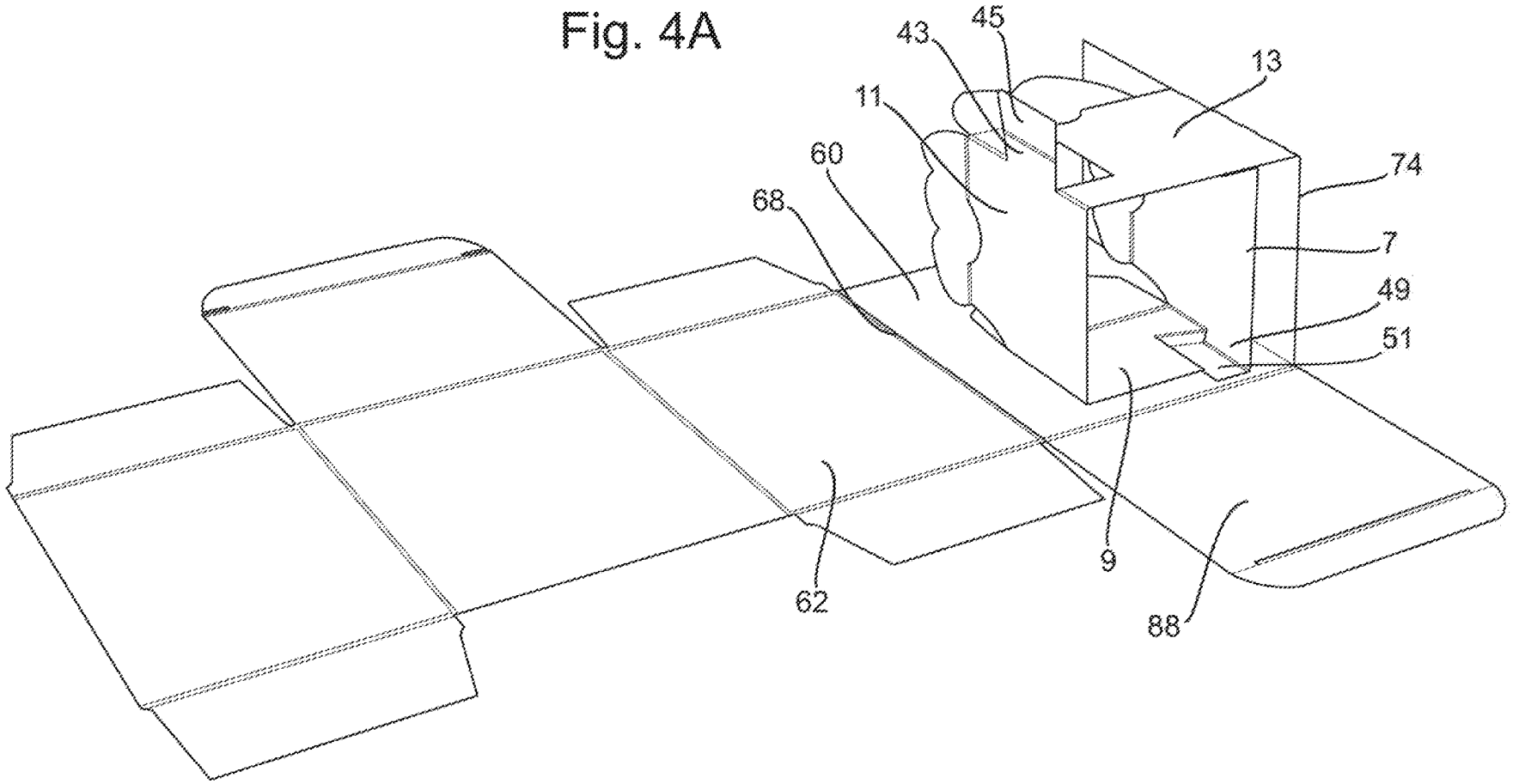
FIG. 4A illustrates the folded blank of FIG. 4 but in an erect configuration for the purposes of illustrating certain features of the folded blank.

In the next step, adhesive is applied to surface of the attachment portion 45 of spacer tab 41 that lies uppermost in FIG. 4. The folded blank is then folded about the foldline 68 in the direction of the arrow shown in FIG. 4 to obtain the arrangement shown in FIG. 5. The inner shell sub-assembly is now sandwiched between the outer shell side wall panels 62, 64 and the outer shell side wall panel 60 and outer shell glue flap 74. The adhesive applied to the attachment portion 45 of spacer tab 41 bonds the spacer tab 41 to the outer shell side wall panel 64. FIG. 5A illustrates the folded and glued blank of FIG. 5 in an erect state from the bottom/second end. Here the gluing of tab 41 to the side wall panel 64 of the outer shell may be seen more clearly.

Figure 5:
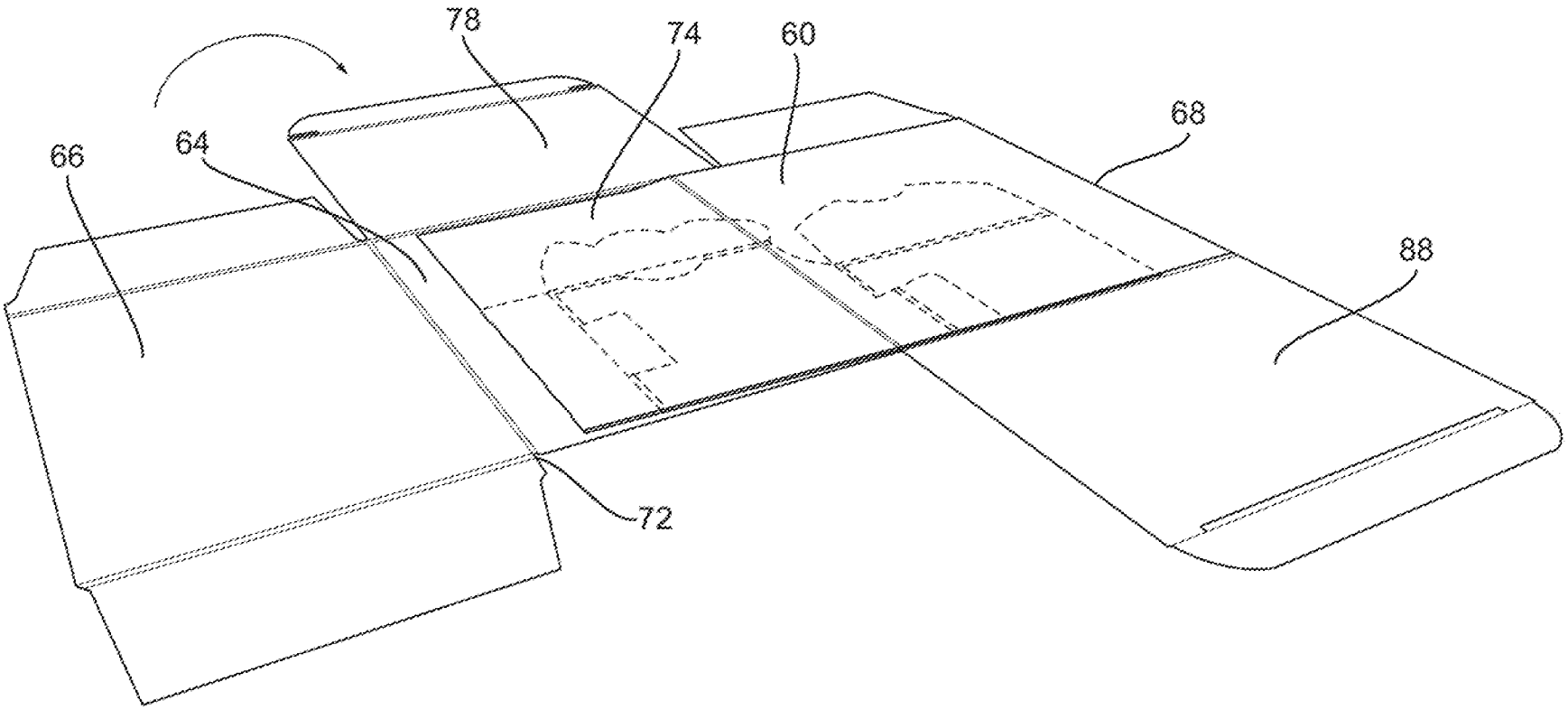
FIG. 5 illustrates the blank of FIG. 4 after a third folding step in a flat configuration.
Figure 5A:
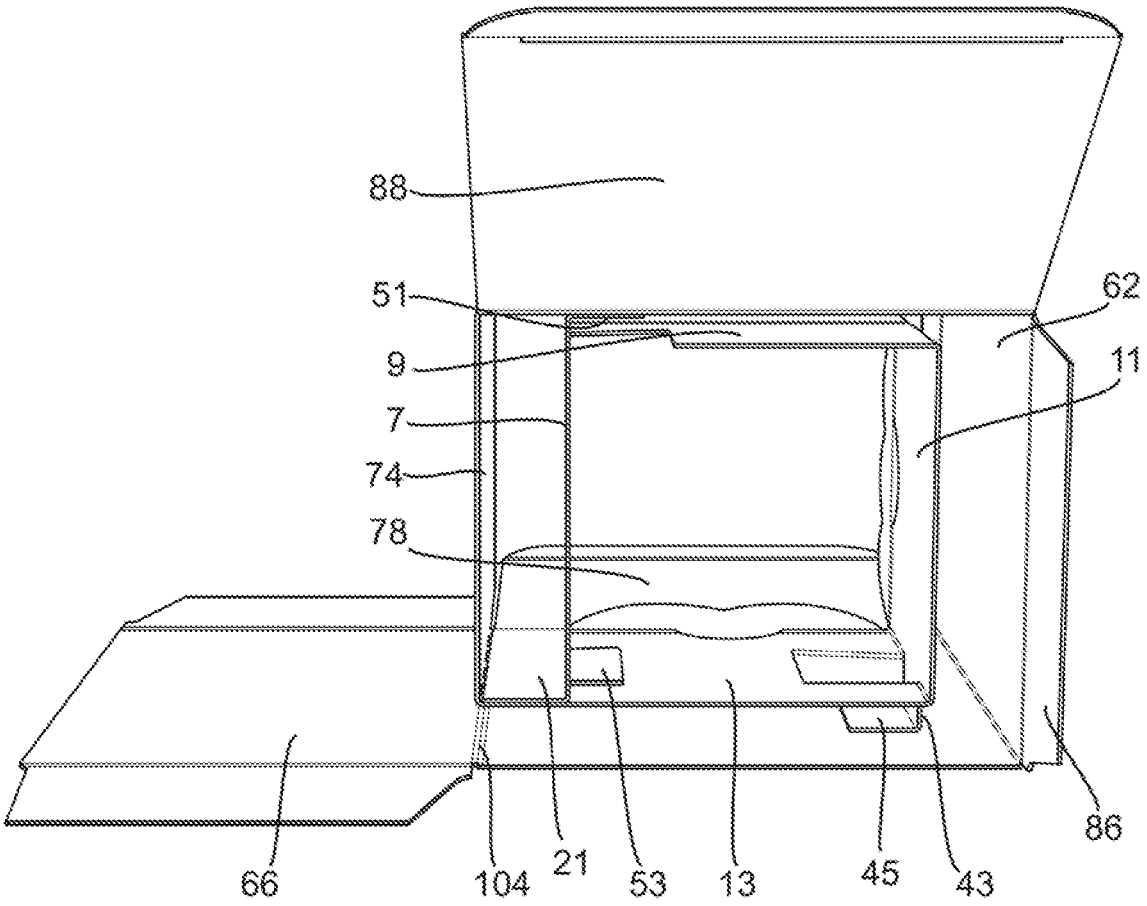
FIG. 5A illustrates the folded blank of FIG. 5 but in an erect configuration for the purposes of illustrating certain features of the folded blank.
Figure 6:
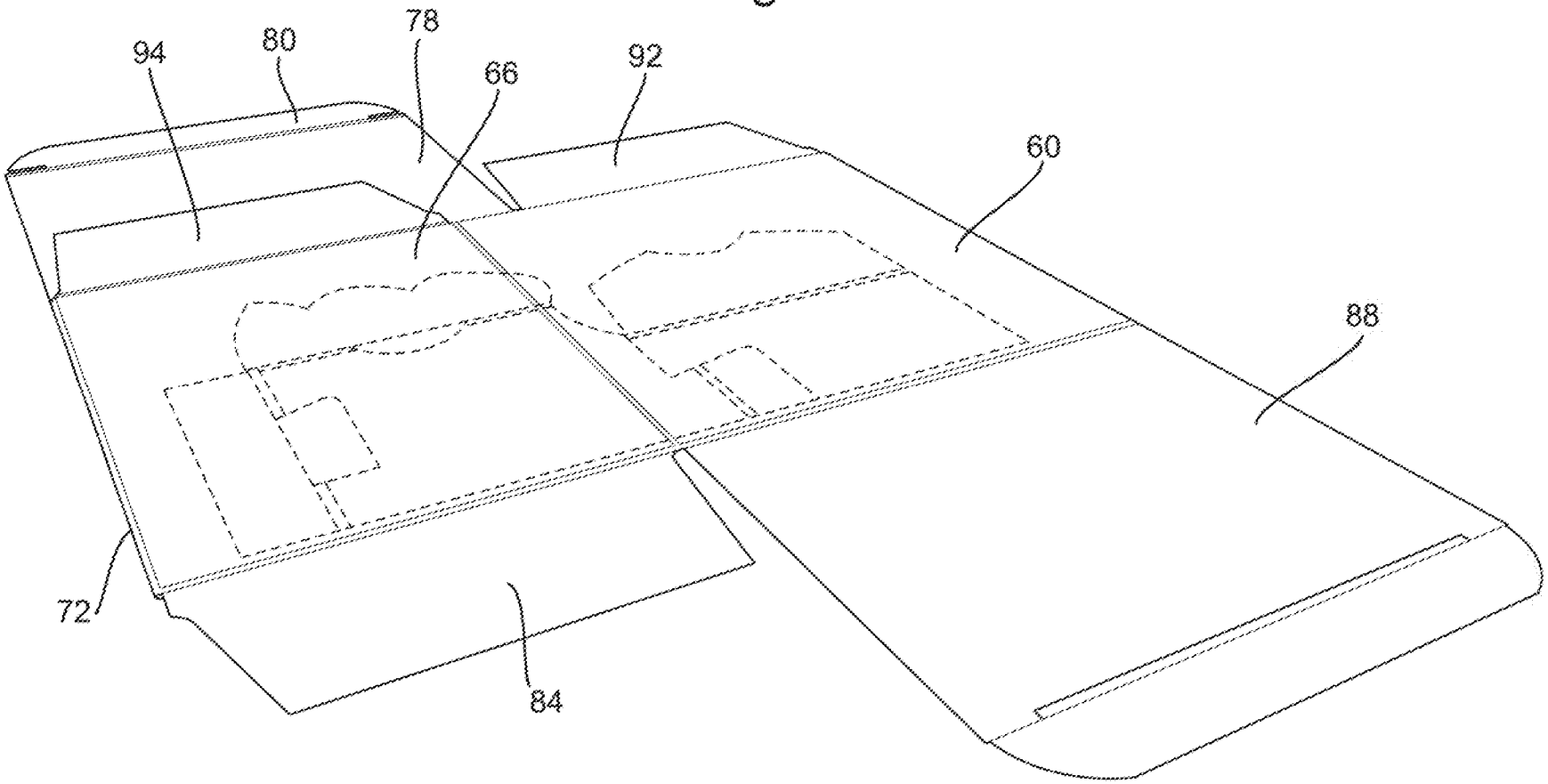
FIG. 6 illustrates the blank of FIG. 2 after a final folding step in a flat configuration.

In the next step, adhesive is applied to the surface of the outer shell glue flap 74 that lies uppermost in FIG. 5. The side wall panel 66 of the outer shell is then folded in the direction of the arrow in FIG. 5 along the foldline 72 so as to overlie the outer shell glue flap 74, providing an arrangement as shown in FIG. 6. The adhesive applied to the exterior surface of the glue flap 74 adheres the side wall panel 66 to the glue flap 74.

It will be appreciated that all stages in folding and gluing the blank may be carried out by passes of a machine which reciprocates along a line e.g. from right to left and back, or vice versa. For example, glue may be applied to the inner shell glue flap 21 in a first pass, then the first fold along line 17 carried out in a second pass. In a third pass glue may be applied to attachment portion 51 and in a fourth pass, the second fold about line 104 is carried out. In a fifth pass glue is applied to the attachment portion 45, and in a sixth pass folding about line 68 occurs. In a seventh pass, glue is applied to the outer shell glue flap 74, and in an eighth pass, folding about line 72 occurs. Of course, this is merely one example of a suitable and simple technique for providing the folding and gluing required, and is not limiting. Any suitable method may be used.

Figure 7:
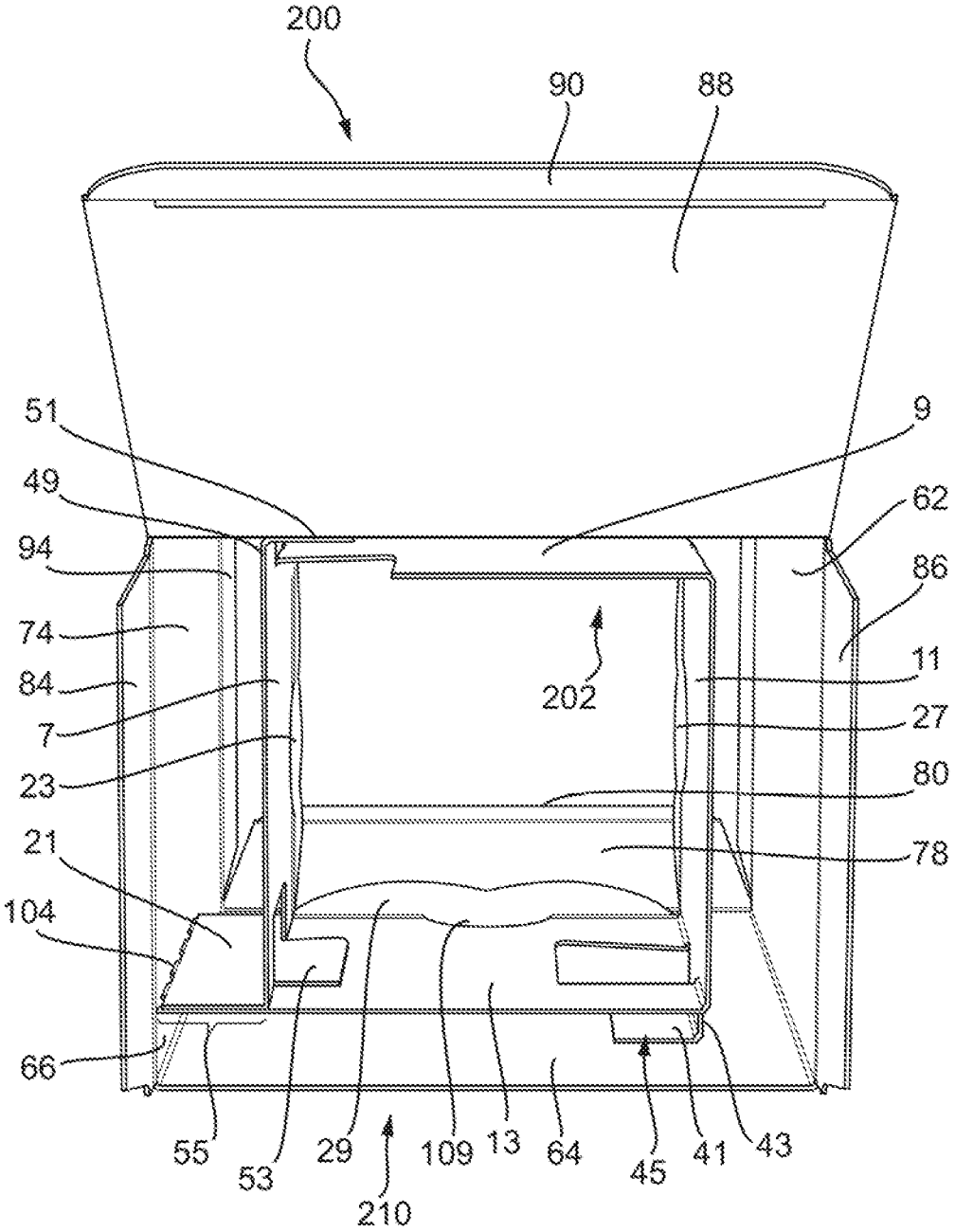
FIG. 7 illustrates the folded blank of FIG. 6 but after erection to provide a container in accordance with the invention, with the ends of the outer shell open for the purposes of illustration, and viewed from the bottom end.

The folded and glued blank is then erected to provide a container 200 as shown in FIG. 7. This may be accomplished in any suitable manner. For example, the construction of the folded and glued blank advantageously enables a single push erection process to be used, although other techniques may equally be used. The spacer tabs 39, 41 help the inner and outer shells to spring up into the erected configuration. FIG. 7 illustrates the erected container from below, with both ends in an open configuration. The product may be loaded into the inner shell from either end, depending upon the configuration of any product support features. The bottom (second) end of the container will be closed, by closing the lid panel 88 over end flaps 86, 84 at the open end and securing it in position using the closure flap 90, and the top (first) end of the outer shell closed by folding the lid panel 78 over the end flaps 92, 94 and securing it in place using closure flap 80. Of course, depending upon the shape of the product and any product support features, it is envisaged that the one end of the outer shell may be closed and the product then loaded therein, before closing of the other end, or both ends may be closed after loading of the product.

Rather than using a closure flap as shown to releasably secure a lid in place over each end of the outer shell, a bonded e.g. glued closure may be provided at one or both ends. The closure flaps 80, 90 may then be omitted. Such a bonded closure may allow an outer shrink wrap to be eliminated.

In the event that a bonded e.g. glued closure is provided at either or both ends, the end flaps 92, 94 or 86, 84 as appropriate may be provided with formations to enable them to be releasably secured to one another to allow a user to reclose the outer shell after initial opening to break the seal. For example, the opposed flaps may respectively include an opening and a tab insertable therein to releasably lock the flaps together.

Some features of the container will now be described by reference to FIG. 7. It will be seen that the container 200 includes an inner shell 202 and an outer shell 210. The inner shell 202 includes the components of the inner shell sub-assembly 3, including the inner shell side wall panels 7, 9, 11, 13. The outer shell 210 is made up of the components of the outer shell sub-assembly 5, including the side wall panels 60, 62, 64, 66, and the end closure flaps/panels. The inner shell 202 is held in an erect configuration using the inner shell glue flap 21 while the outer shell 210 is held in an erect configuration using the outer shell glue flap 74. The inner shell 202 is spaced from the outer shell 210 by the spacer tabs 39, 41. The connecting portions 49, 43 bridge the gap between the inner shell and the outer shell. The inner shell 210 is integrally connected to the outer shell 202 by the attachment of the connecting portion 55 of the inner shell side wall panel 13 to the outer shell glue flap 74 along the foldline 104.

The container according to embodiments of the invention is advantageous in that all of the components of an inner shell may be connected to the components of the outer shell by a foldline. In the embodiments illustrated the connection is via a foldline between a side wall panel of the inner shell and the outer shell glue flap. However, it will be appreciated that other options are possible, e.g. involving a foldline between other flaps/panels of the inner shell and the outer shell. The construction which uses spacer tabs released from panels of the inner shell and extending between the inner shell and the outer shell, and secured thereto, provides a robust inner shell structure which may protect a product located therein from multi-directional impacts, and facilitates erection e.g. after all folding and gluing of a blank is complete. The number of spacer tabs may vary from that illustrated. Similarly, the number of side wall panels of the inner and outer shell may vary from that illustrated.

All of the steps of the erection method described by reference to FIGS. 2-7, including all gluing and folding steps, may be performed in a fully automated manner by a machine.

The container illustrated enables a standard corrugated liner used in e.g. perfume packaging to be eliminated.

The containers described herein may be used with any desired product, but are particularly useful in the context of fragile products, such as bottles e.g. perfume bottles.

Various features may be used to help to support a product located in the container in use.

The embodiment shown in FIGS. 1-7 includes product support flaps 23, 25, 27, 29.

Referring to the container 200 shown in FIG. 7, it may be seen that these flaps may help to support the top of a product e.g. a bottle neck. The way in which these flaps function will be described by reference to flap 23. The bottle neck engages the flap 23 causing the flap 23 to hinge outwardly about the foldline 31 connecting it to its respective side wall panel, causing the associated lug 106 to cantilever inwardly toward the bottle, restricting lateral movement of the bottle. The neck of the bottle may, depending upon bottle shape e.g. if the neck is of greater diameter than a lower part of the bottle, engage the flap 23 to cause the lug 106 to move inwardly in this manner at all times, or only if caused to move laterally outwardly from the longitudinal axis of the inner shell e.g. due to an impact. In either case, any impact causing the bottle neck to move laterally outwardly will cause the neck to engage the flap 23 to a (greater) extent, causing the lug 106 to move inwardly. In this way, the lugs 106, 108, 109 will restrict movement of the product e.g. bottle upon impact, e.g. drop impact, reducing the risk of damage by holding the bottle more centrally in the container.

The lugs 106, 108, 109 are only optional, and the product support flaps 23, 25, 27, 29 may be used without such lugs. Furthermore, while the embodiments illustrated shows lugs associated with three of the side walls of the inner shell, lugs may be associated with any one or ones of the inner shell side walls, and may be associated with each of the side walls.

The shape of the upper edges of the product support flaps may vary from that illustrated. The shape may be used to provide a desired aesthetic effect and/or bottle support. For example, while only one of the flaps, flap 25 is shown as including a recess 26 to support the neck of a bottle, additional flaps, such as an opposed flap, or all flaps may include such a feature. Rather than including curvilinear upper edges one or more, or all product support flaps may be rectilinear. The shape and configuration of product support flaps, and whether indeed any, or any particular number of such flaps are provided, will depend upon the nature of the product with which the container is to be used.

Figure 7A:
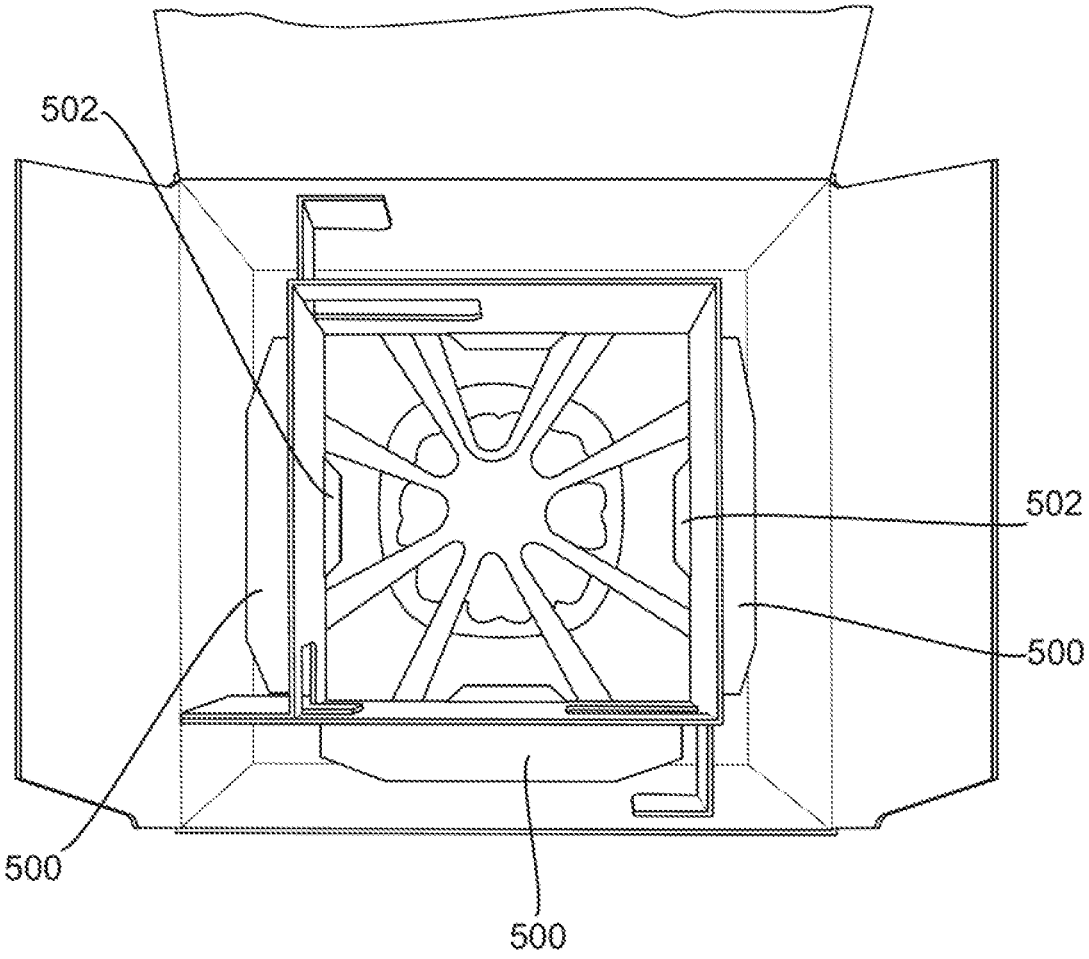
FIG. 7A illustrates a container similar to that of the first embodiment with the lid open as viewed from the bottom end, and showing the interaction between the product support flaps and a product located therein.

FIG. 7A is a view from the bottom end of a container incorporating such product support flaps, with the bottom end open, showing the way in which the lugs 502 may inhibit lateral movement of a product located in the container when the neck of the product urges the flaps 500 associated with the lugs outwardly. The shape of the product support flaps, and certain other features, differ slightly from those of the first embodiment, but the embodiment is of the same general construction.

A product e.g. bottle located in the container may be suspended by cooperation with the product support flaps above the base of the container provided by the bottom panel 88 of the outer shell.

It will be appreciated that the number and relative dimensions of the side wall panels of the outer and inner shells may vary depending upon the product to be held and the desired shape and configuration of the container. The inner shell side walls may be of differing heights.

Figure 8:
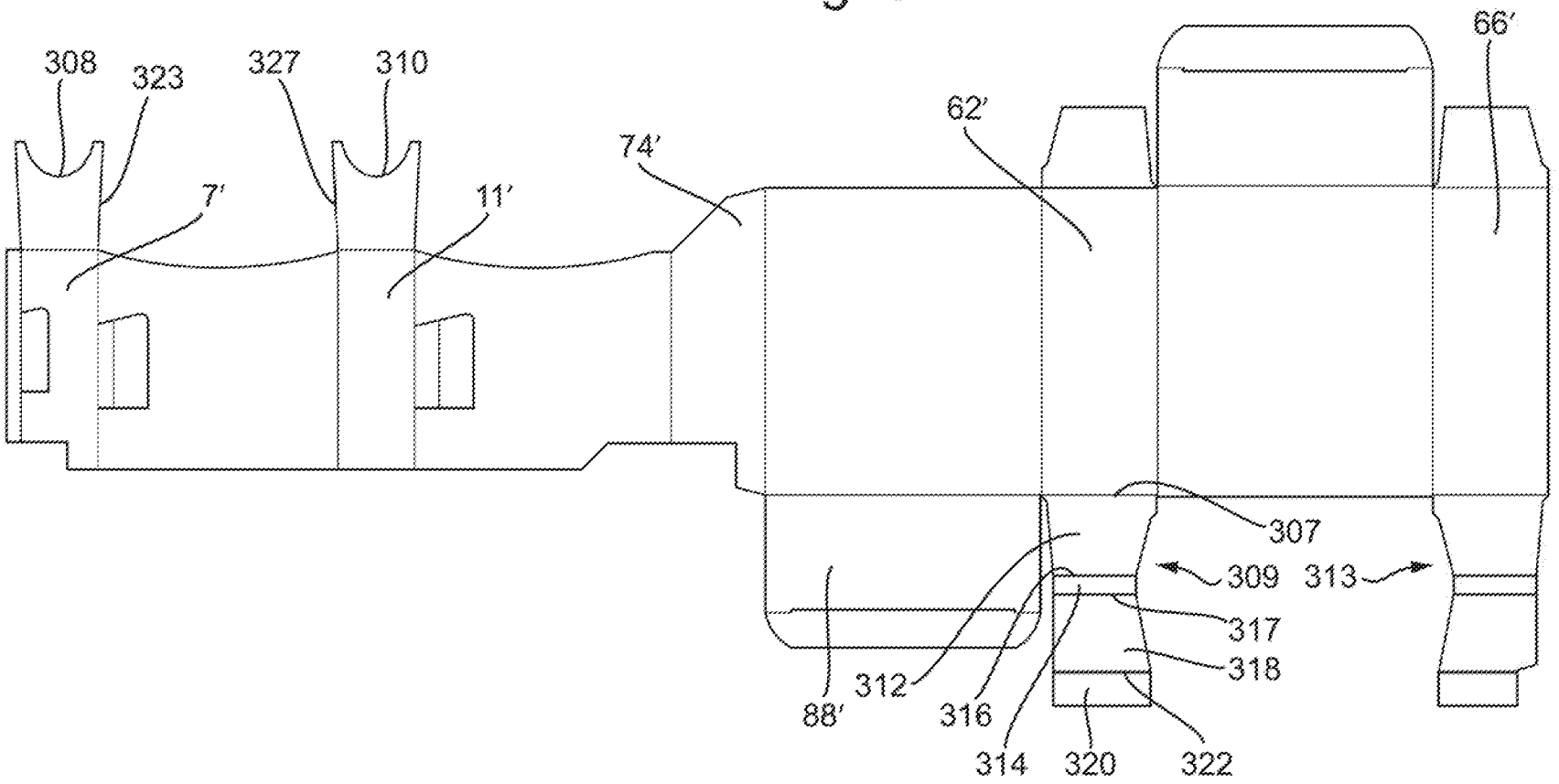
FIG. 8 illustrates a blank in the flat for providing a container in accordance with a second embodiment of the invention.

FIG. 8 illustrates a blank for a container in accordance with a second embodiment of the invention. This is of similar construction to the first embodiment described above, and may be erected in the same manner. This embodiment differs only in respect of the relative dimensions of the side wall panels of the inner and outer shells (to provide a rectangular shape container), and the product support arrangements. Corresponding features have corresponding reference numerals to the first embodiment, but annotated by "'". FIG. 8 shows the blank in the flat from above, from the side which will provide the exterior surfaces of the inner and outer shells in the erected container.

In the embodiment of FIG. 8 only one opposed pair of inner shell side wall panels 7', 11' include product support flaps 323, 327. Each includes a recess 308, 310 providing a collar to support a bottle neck.

In this embodiment the outer shell also includes a product support feature. The end flaps at the second (bottom) end of the outer shell have been modified to include a plurality of panels for providing respective platform end flaps 309, 313. The construction of these platform end flaps will be described by reference to flap 309. Flap 313 is of identical construction. The flap 309 includes a first panel 312 connected along a foldline 307 to its respective side wall panel 62'. The first panel is connected along a foldline 316 to a second panel 314. The second panel 314 is connected along a foldline 317 to a third panel 318. The third panel 318 is connected along a foldline 322 to a fourth panel 320. In erecting the container, the third panel 318 is folded over the first panel 312 to so as to be spaced therefrom by the second panel 314, and the fourth panel 320 is secured to the side wall panel 62' at a position to retain the end flap in this folded configuration, thus providing a platform end flap. The first and third panels are held substantially parallel to one another. The lid panel 88' may then be folded over the platform end flaps in the same manner as with standard end flaps.

Such platform end flaps may be used at either or both ends of the outer shell, and provide improved cushioning against impact, and may be used in combination with any type of product support arrangement provided by the inner shell.

In the embodiment of FIG. 8, the shape of the outer shell glue flap 74' has been modified to include a cutaway at the second (bottom end) to enable the first panel of the platform flap 313 to be glued directly to its associated side wall panel.

It will be appreciated that the outer shell glue flap may, in various embodiments, be of any desired shape. The shape may depend upon the relative dimensions e.g. heights of the inner and outer shells, and position of the inner shell relative to the outer shell.

Figure 9:
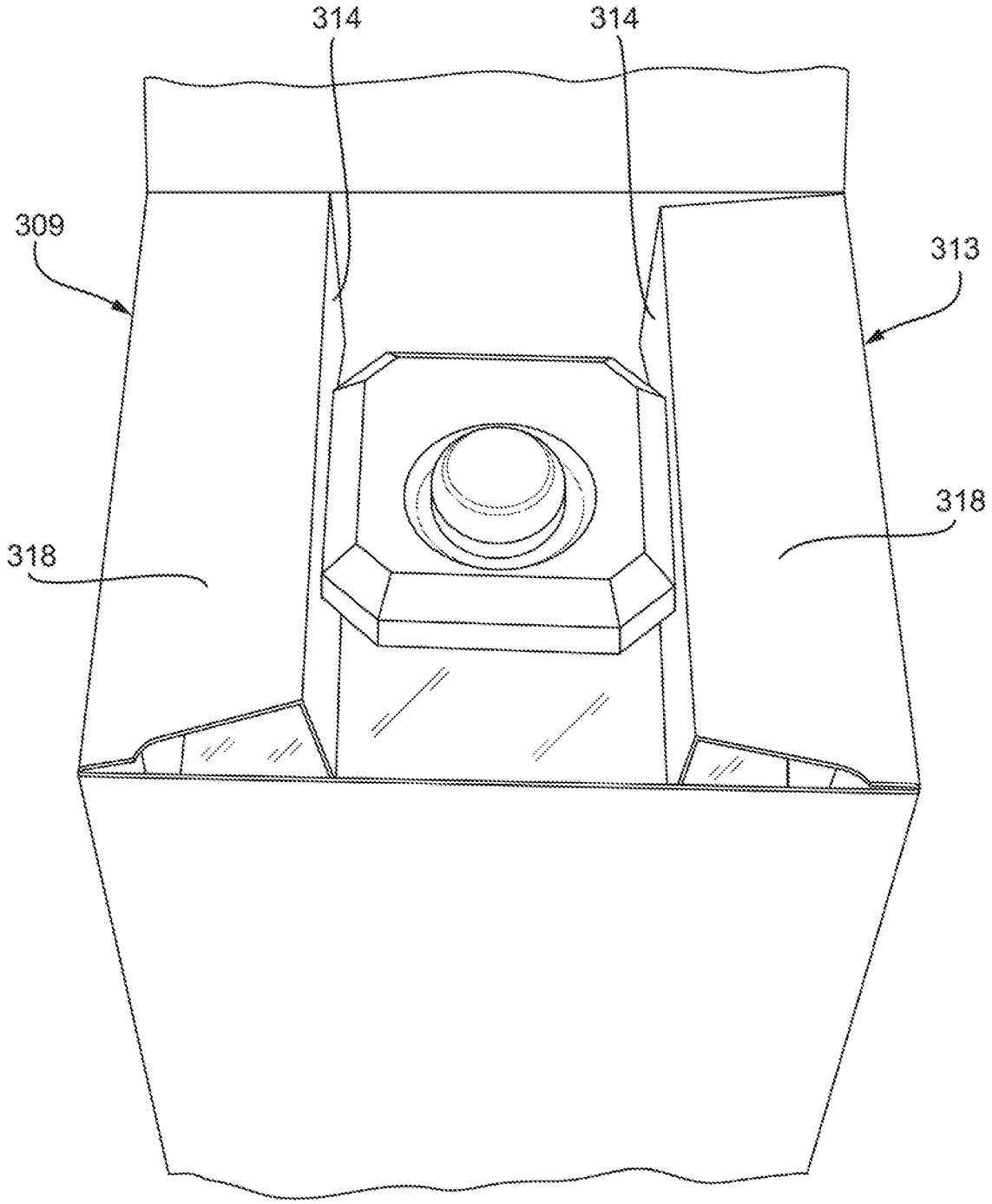
FIG. 9 illustrates the top end of a container in accordance with the second embodiment with the lid open and showing the interaction between the platform end flaps and a product located therein.

FIG. 9 illustrates the way in which platform end flaps 309, 313 may cooperate with the end of a bottle located in a container including such flaps. FIG. 9 illustrates the case in which the end flaps are associated with the top of the outer shell. The lid panel is open for ease of illustration.

It is not necessary to provide additional product support features on either or both of the inner and outer shells in all embodiments, and product support features may be provided in relation to only one of the inner and outer shell. For example, platform end flaps as shown in FIG. 8 may be used alone, at one or both ends of the outer shell, without product support flaps being provided on the inner shell.

Figure 10:
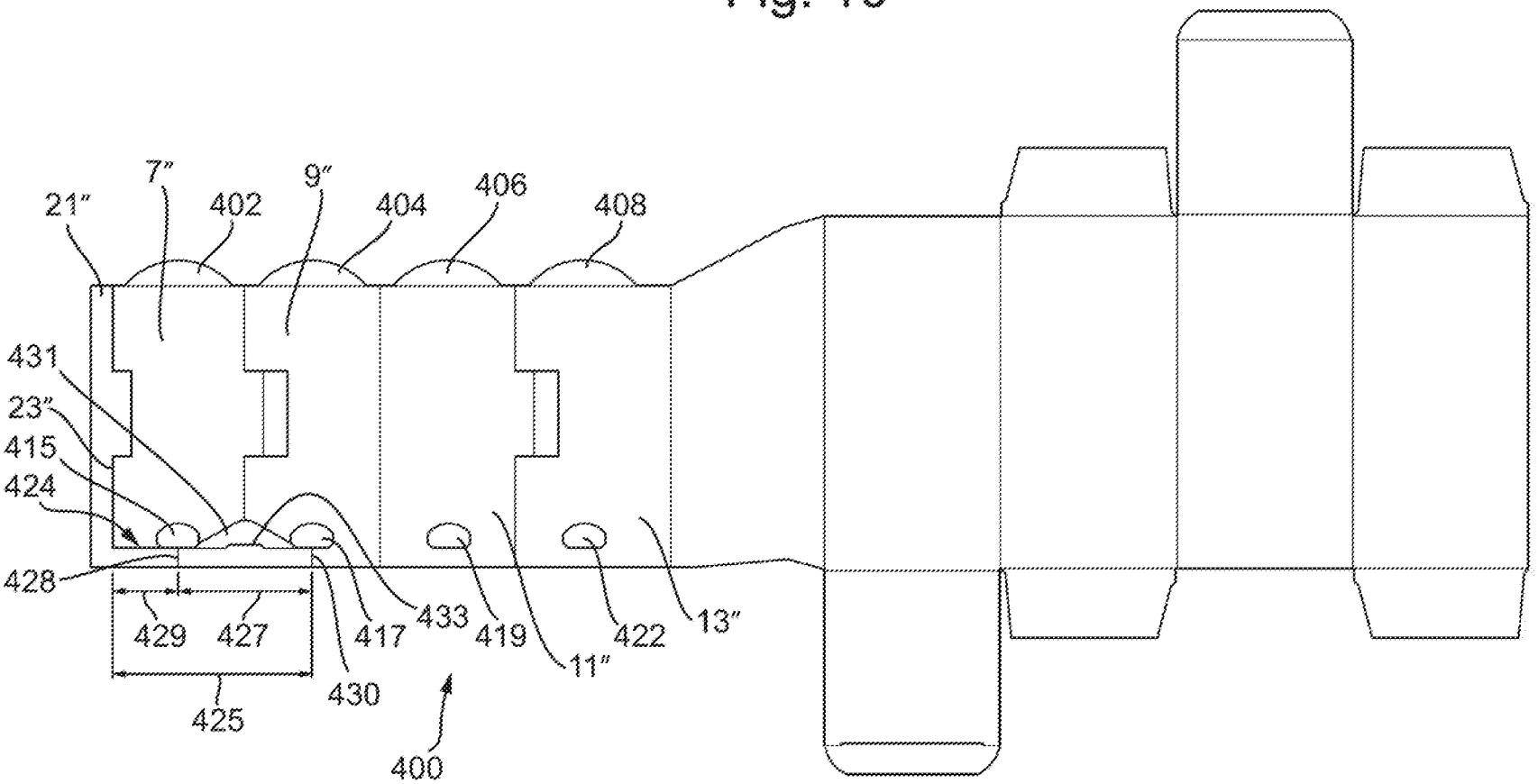
FIG. 10 illustrates a blank in the flat for providing a container in accordance with a third embodiment of the invention.

FIG. 10 illustrates a further embodiment of a blank 400 for a container, which illustrates some additional product support features which may be used. Again, only the features which differ from the earlier embodiments will be described in detail. Corresponding features have corresponding reference numerals to the first embodiment, but annotated by "'". FIG. 10 shows the blank in the flat from above, from the side which will provide the exterior surfaces of the inner and outer shells in the erected container.

In this embodiment, the product support flaps of the inner shell do not include lugs, and are in the form of simple curved flaps 402, 404, 406, 408. Of course, product support flaps of any of the other configurations exemplified herein may be used, or the flaps may be omitted.

In this embodiment, each one of the inner shell side wall panels 7", 9", 11", 13" includes an opening 415, 417, 419, 422. These openings may help to locate a base of a product e.g. bottle, suspending it above the base of the outer shell. Such base locating openings may be incorporated in any of the embodiments described herein.

Figure 11:
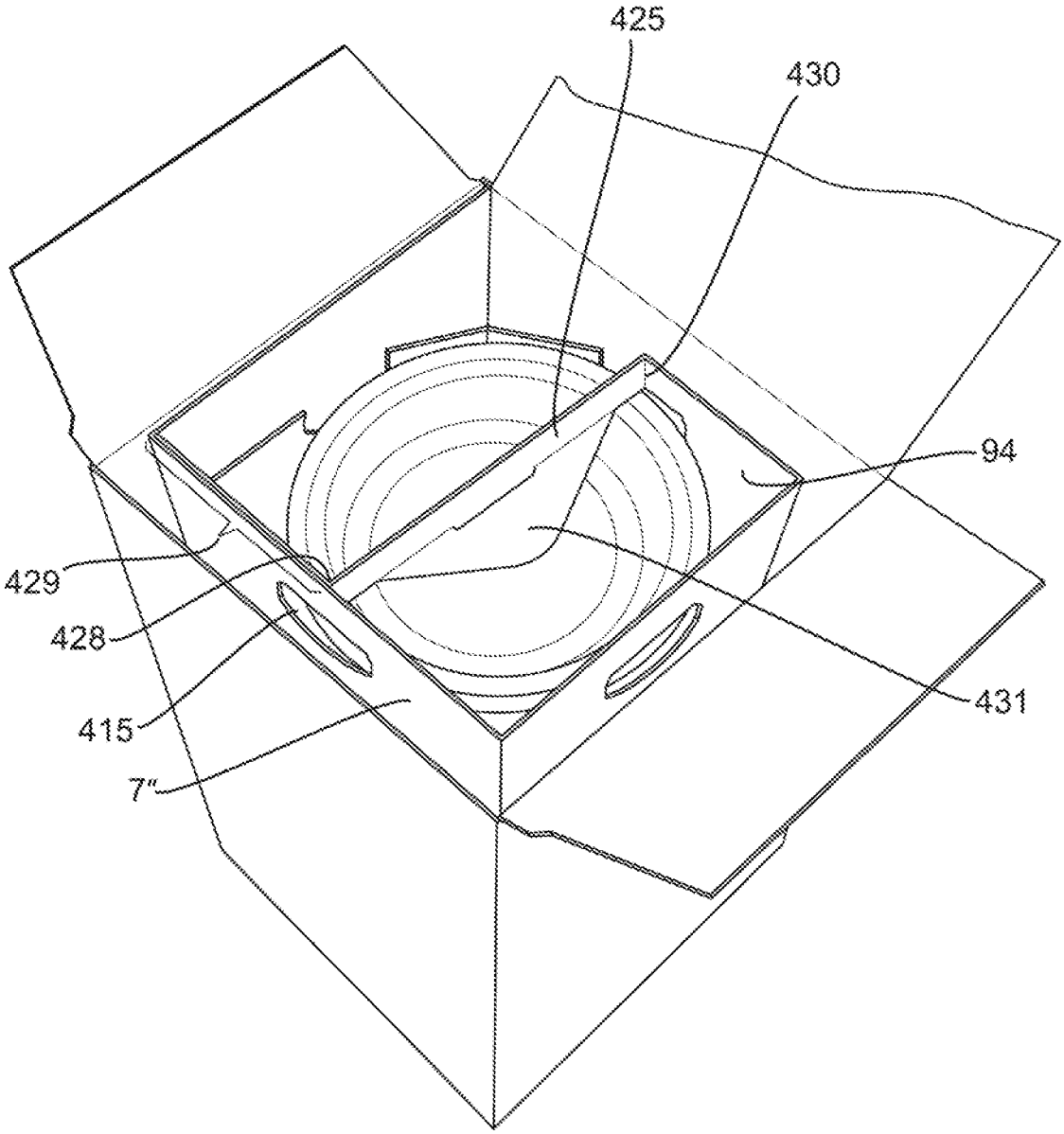
FIG. 11 illustrates the bottom end of a container in accordance with the third embodiment with the lid open and showing the interaction between the product supporting strip and a product located therein.

A cutline 424 extends between panels 7", 9" to define a strip 425. The cutline extends from the edge of panel 7" (defined by the foldline 23" connecting the panel to the glue flap 21") to the edge of the opening 417 in panel 9". A first portion 427 of the strip 425, defined between the foldlines 428, 430 will extend between the opposed panels 7", 9" in the erected container, as shown in FIG. 11 to provide support for the base of the product. A second portion 429 of the strip, defined between the edge of panel 7" and the foldline 428 is adhered to the panel 9" to retain the first portion 425 of the strip in position in use. In the illustrated embodiment, the cutline 424 defines a flap 431 connected to the first portion 427 of the strip 425 by a foldline 433 to provide a platform for supporting the product. The flap is released from the panels 7", 9". Such a flap is optional.

FIG. 11 illustrates a container according to the FIG. 9 embodiment from the bottom (second) end, with the end closure of the outer shell open for the purposes of illustration.

It will be appreciated that a product support strip as shown in FIGS. 8 and 9 may be used alone or in conjunction with any of the other product support features described, whether at the top of the inner shell, or at one or both ends of the outer shell.

Any of the product support features described may be used in any combination, as desired according to a particular product to be supported. Such features may be provided in association with either or both of the inner and outer shell e.g. product support flaps, platform flaps, product support recesses in flaps etc.

While attachments have been described as adhesive attachments herein, it will be appreciated that any suitable bonding technology e.g. heat sealing may be used, or combinations of such technologies.

It will be understood that the above description is of a number of exemplary embodiments only and that modifications may be made to the embodiments without departing from the scope of the invention.

References to an element (e.g. tab or lug) being "released from" a component e.g. panel or wall refers to the respective element being cut from that component e.g. panel or wall.

The component e.g. panel or wall may define a recess e.g. opening corresponding to the shape of the element released therefrom.

EXAMPLES

Below are given a list of examples of the present disclosure.

Example 1

A single piece container made from cardboard, paperboard or other lightweight foldable sheet material, the container comprising:

an outer shell having a first end and a second end, and comprising a plurality of side wall panels hingedly connected to one other about respective outer shell sidewall foldlines and extending between the first end and the second end of the outer shell, wherein at least the second end of the outer shell is a closed end;

and an inner shell, wherein the inner shell comprises a first end, an opposite second end, and a plurality of side walls hingedly connected to one another about respective inner shell sidewall foldlines and extending between the first end and the second end of the inner shell, wherein the inner shell is integrally connected to the outer shell along a foldline;

and at least one spacer tab connecting the inner shell and the outer shell, the spacer tab being released from a respective side wall panel of the inner shell.

Example 2

The container of example 1 wherein a plurality of spacer tabs are provided, being released from different respective side walls of the inner shell, wherein spacer tabs are provided which are released from respective ones of a pair of opposed side wall panels of the inner shell.

Example 3

The container of any preceding example wherein, for the or each spacer tab provided, a base of the spacer tab extends from an edge of a side wall panel of the inner shell adjacent the side wall panel from which the spacer tab is released, optionally wherein the base of the spacer tab interrupts a foldline connecting the side wall panel from which the spacer tab is released to the adjacent side wall panel.

Example 4

The container of any preceding example wherein each spacer tab has a connecting portion extending between the inner shell and the outer shell and an attachment portion attached to the outer shell, the connecting and attachment portions being connected to one another about a foldline.

Example 5

The container of any preceding example wherein one of the side wall panels of the inner shell is integrally connected to the outer shell along said foldline.

Example 6

The container of example 5 wherein the side wall panel of the inner shell which is integrally connected to the outer shell along the foldline comprises a connecting portion which connects the inner shell to the outer shell, wherein the connecting portion extends from an edge of an adjacent side wall panel of the inner shell at a proximal end thereof, and is connected to the outer shell along the foldline at a distal end thereof.

Example 7

The container of example 6 wherein the inner shell comprises an inner shell glue flap connected along a fold line to one of the side wall panels of the inner shell, which inner shell glue flap is attached to the connecting portion of the side wall panel of the inner shell to retain the inner shell in an erect configuration.

Example 8

The container of example 7 wherein a tab is released from the side wall panel of the inner shell to which the inner shell glue flap is connected, the tab having a base which extends from a proximal edge of the inner shell glue flap, and wherein the tab is attached to the interior of the inner shell side wall panel to which the inner shell glue flap is attached, optionally wherein the base of the tab interrupts the foldline connecting the inner shell glue flap to the side wall panel to which it is connected.

Example 9

The container of example 8 wherein the tab is attached to the side wall panel of the inner shell so as to extend inwardly from the edge of the adjacent side wall panel into the interior of the inner shell.

Example 10

The container of any preceding example wherein the outer shell comprises an outer shell glue flap connected along a foldline to one of the side wall panels of the outer shell and which outer shell glue flap is attached to the interior of an adjacent side wall panel of the outer shell to retain the outer shell in an erect configuration, wherein the foldline along which the inner shell is integrally connected to the outer shell connects the inner shell, optionally a side wall panel of the inner shell, to a distal edge of the outer shell glue flap.

Example 11

The container of example 10 wherein the outer shell glue flap extends from the outer shell side wall panel to which the outer shell glue flap is connected towards an opposed side wall panel of the outer shell along the interior of the adjacent side wall panel, wherein the adjacent side wall panel connects the opposed side wall panels, and wherein the outer shell glue flap extends over only a portion of the distance between the opposed side wall panels.

Example 12

The container of any preceding example wherein each one of at least one pair of opposed side wall panels of the inner shell comprises a respective product support flap connected to a first end thereof along a foldline.

Example 13

The container of example 12 wherein a distal edge of each one of at least one pair of the at least one pair of opposed product support flaps comprises means for locating a product in use, wherein the locating means comprises a recess.

Example 14

The container of example 12 or example 13 wherein, for at least some of the inner shell side wall panels having a product support flap connected along an end thereof along a foldline, a lug is provided, the lug being released from the side wall panel, and the base of the lug extending from the proximal edge of the product support flap.

Example 15

The container of any preceding example wherein, at one or both ends of the outer shell, each one of a pair of opposed side wall panels of the outer shell comprises a respective product support flap connected to an end thereof along a foldline.

Example 16

The container of example 15 wherein each product support flap comprises a first panel connected at a proximal end thereof along a foldline to the end of the side wall panel, a second panel connected at a proximal end thereof along a foldline to the distal end of the first panel, a third panel connected at a proximal end thereof along a foldline to the distal end of the second panel, and a fourth panel connected at a proximal end thereof along a foldline to the distal end of the third panel, the fourth panel being attached to the interior of the side wall panel having the product support flap, and wherein the second panel spaces the first and third panels from one another.

Example 17

The container of any preceding example wherein one or more of the side wall panels of the inner shell comprises an opening at the second end thereof for locating a product when disposed in the inner shell in use.

Example 18

The container of any preceding example wherein a product supporting strip extends between opposed side wall panels of the inner shell at the second end thereof.

Example 19

The container of example 18 wherein the product supporting strip is defined by a cutline extending across a foldline connecting adjacent ones of the side wall panels.

Example 20

The container of example 18 or example 19 wherein a product supporting flap is connected to the product supporting strip along a foldline to provide a platform for supporting a product located in the inner shell in use.

Example 21

A single piece blank made from cardboard, paperboard or other lightweight foldable sheet material, the blank being erectable to provide a container having an outer shell and an inner shell, the blank comprising:

an outer shell sub-assembly comprising;

a set of outer shell side wall panels connected to each other about respective outer shell side wall panel foldlines for providing the side walls of an outer shell, at least one end panel for closing an end of the outer shell, and an outer shell glue flap connected to one of the outer shell side wall panels along a foldline;

an inner shell sub-assembly comprising;

a set of inner shell side wall panels connected to each other about respective inner shell side wall panel foldlines for providing the side walls of an inner shell, and an inner shell glue flap connected to one of the inner shell side wall panels along a foldline;

wherein the inner shell sub assembly is integrally connected to the outer shell sub assembly along a foldline, preferably wherein one of the inner shell side wall panels of the inner shell sub assembly is integrally connected to the outer shell sub assembly along the foldine;

and the blank further comprising at least one spacer tab for connecting the inner shell and the outer shell when the blank is erected, the spacer tab being released from a respective inner shell side wall panel.

Example 22

The blank of example 21 wherein a plurality of spacer tabs are provided, being released from different respective inner shell side wall panels, wherein spacer tabs are provided which are released from respective ones of the inner shell side wall panels which will form a pair of opposed side wall panels of the inner shell when the blank is erected.

Example 23

The blank of example 21 or example 22 wherein a base of the or each spacer tab provided extends from an edge of an inner shell side wall panel adjacent the inner shell side wall panel from which the spacer tab is released, optionally wherein the spacer tab interrupts a foldline connecting the inner shell side wall panel to the adjacent inner shell side wall panel.

Example 24

The blank of any one of examples 21 to 23 wherein each spacer tab has a connecting portion for extending between the inner shell and the outer shell when the blank is erected and an attachment portion for attachment to the outer shell, the connecting and attachment portions being connected to one another about a foldline.

Example 25

The blank of any one of examples 21 to 24 wherein an inner shell side wall panel of the inner shell sub assembly is integrally connected to the outer shell sub-assembly along a foldline, and the inner shell side wall panel comprises a connecting portion connected to the outer shell sub-assembly along the foldline to which the inner shell glue flap may be attached during erection of the blank, optionally wherein the connecting portion has a width which is at least as great as a width of the inner shell glue flap.

Example 26

The blank of any one of examples 21 to 25 wherein an inner shell side wall panel is integrally connected to the outer shell sub-assembly along a foldline, and the foldline along which the inner shell side wall panel is integrally connected to the outer shell sub-assembly connects the inner shell side wall panel to a distal edge of the outer shell glue flap.

Example 27

The blank of any one of examples 21 to 26 wherein the outer shell glue flap has a width which is less than a width of the adjacent outer shell side wall panel to which it is connected to erect the blank.

Example 28

The blank of any one of examples 21 to 27 wherein an inner shell side wall panel is integrally connected to the outer shell sub-assembly along a foldline, and a tab is released from the inner shell side wall panel to which the inner shell glue flap is connected along a foldline, the tab having a base which extends from a proximal edge of the inner shell glue flap.

Example 29

The blank of any one of examples 21 to 28 wherein at least some of the inner shell side wall panels comprise a respective product support flap connected to an end thereof along a respective foldline.

Example 30

The blank of example 29 wherein, for at least some of the inner shell side wall panels having a product support flap connected along an end thereof along a respective foldline, a lug is provided, the lug being released from the side wall panel to which the product support flap is connected, the base of the lug extending from the proximal edge of the product support flap.

Example 31

The blank of any one of examples 21 to 30 wherein, at one or both ends of the outer shell sub-assembly, each one of a pair of opposed outer shell side wall panels comprises a respective product support flap connected to an end thereof along a foldline.

Example 32

The blank of example 31 wherein each product support flap comprises a first panel connected at a proximal end thereof along a foldline to the end of the side wall panel, a second panel connected at a proximal end thereof along a foldline to the distal end of the first panel, a third panel connected at a proximal end thereof along a foldline to the distal end of the second panel, and a fourth panel connected at a proximal end thereof along a foldline to the distal end of the third panel, wherein the first and third panels are of equal length.

Example 33

The blank of any one of examples 21 to 32 wherein the inner shell sub-assembly comprises a cutline extending across a foldline connecting adjacent ones of the inner shell side wall panels and defining a product supporting strip.

Example 34

The blank of example 33 wherein a product supporting flap is connected to the product supporting strip along a foldline.

It will be appreciated that the features of any of these examples may be used either separately, or in any combination.

The invention claimed is:

1. A single piece container made from cardboard, paperboard or other lightweight foldable sheet material, the container comprising:

an outer shell having a first end and a second end, and comprising a plurality of side wall panels hingedly connected to one another about respective outer shell sidewall foldlines and extending between the first end and the second end of the outer shell, wherein at least the second end of the outer shell is a closed end; and an inner shell, wherein the inner shell comprises a first end, an opposite second end, and a plurality of side walls hingedly connected to one another about respective inner shell sidewall foldlines and extending between the first end and the second end of the inner shell, wherein the inner shell is integrally connected to the outer shell along a fold line; and at least one spacer tab connecting the inner shell and the outer shell, the spacer tab being cut from a respective side wall panel of the inner shell;

wherein one of the side wall panels of the inner shell is integrally connected to the outer shell along said fold line, wherein the side wall panel of the inner shell which is integrally connected to the outer shell along the fold line comprises a connecting portion which connects the inner shell to the outer shell, wherein the connecting portion extends from an edge of an adjacent side wall panel of the inner shell at a proximal end of the connecting portion, and is connected to the outer shell along the fold line at a distal end of the connecting portion;

wherein the inner shell comprises an inner shell glue flap connected along a fold line to one of the side wall panels of the inner shell, which inner shell glue flap is attached to the connecting portion of the side wall panel of the inner shell to retain the inner shell in an erect configuration;

wherein a tab is cut from the side wall panel of the inner shell to which the inner shell glue flap is connected along the fold line, the tab having a base which extends from a proximal edge of the inner shell glue flap, and wherein the tab is attached to the interior of the inner shell side wall panel having the connecting portion to which the inner shell glue flap is attached, wherein the base of the tab interrupts the fold line connecting the inner shell glue flap to the side wall panel to which the inner shell glue flap is connected, and wherein the tab is attached to the side wall panel of the inner shell so as to extend inwardly from the edge of the adjacent side wall panel into the interior of the inner shell.

2. The container of claim 1 wherein each one of at least one pair of opposed side wall panels of the inner shell comprises a respective product support flap connected to a first end thereof along a fold line.

3. The container of claim 2 wherein a distal edge of each one of at least one pair of the at least one pair of opposed product support flaps comprises means for locating a product in use, wherein the locating means comprises a recess.

4. The container of claim 2 wherein, for at least some of the inner shell side wall panels having a product support flap connected along an end thereof along a fold line, a lug is provided, the lug being released from the side wall panel, and the base of the lug extending from the proximal edge of the product support flap.

* * * * *